US005618247A

United States Patent [19]

Perez

[11] Patent Number: 5,618,247

[45] Date of Patent: Apr. 8, 1997

[54] EXERCISE LEG DEVICE

[76] Inventor: Jose L. Perez, 35-30 91st St., Jackson Heights, N.Y. 11372

[21] Appl. No.: 705,172

[22] Filed: Aug. 29, 1996

[51] Int. Cl.[6] ..... A63B 23/04

[52] U.S. Cl. ..... 482/60; 482/904

[58] Field of Search ..... 482/57, 60, 904, 482/148, 62, 63, 64, 65

[56] References Cited

U.S. PATENT DOCUMENTS

| | | | |
|---|---|---|---|
| 4,225,130 | 9/1980 | Zimmerman | 482/60 |
| 4,265,447 | 5/1981 | Shafer | 482/60 |
| 5,163,889 | 11/1992 | Kaaua | 482/140 |
| 5,186,698 | 2/1993 | Mason et al. | 482/79 |
| 5,213,558 | 5/1993 | Miller et al. | 482/140 |
| 5,342,274 | 8/1994 | Hunker | 482/140 |
| 5,540,641 | 7/1996 | Williams et al. | 482/904 |
| 5,540,643 | 7/1996 | Fontaine | 482/904 |

*Primary Examiner*—Stephen R. Crow
*Attorney, Agent, or Firm*—Richard L. Miller, P. E.

[57] ABSTRACT

A leg exercise device that is replaceably attachable to an open door that includes a first generally L-shaped assembly abuttable against a first side of the open door and a free vertical edge of the open door, a second generally L-shaped assembly, abuttable against a second opposing side of the open door and overlapping a part of the first generally L-shaped assembly, width maintaining apparatus to maintain the first generally L-shaped assembly abuttable against the first side of the open door and the second generally L-shaped assembly abuttable against the second opposing side of the open door, a first flat, vertically-oriented, forwardly-facing, and inverted J-shaped height adjusting arm hookable on, and suspendable from, a doorknob on the first side of the open door, first height maintaining apparatus to maintain the first generally L-shaped assembly a predetermined distance below the doorknob on the first side of the open door, a second flat, vertically-oriented, forwardly-facing, and inverted J-shaped height adjusting arm hookable on, and suspendable from, a doorknob on the second opposing side of the open door, second height maintaining apparatus to maintain the second generally L-shaped assembly a predetermined distance below the doorknob on the second opposing side of the open door, and a pedal assembly rotatively attached to the second generally L-shaped assembly.

30 Claims, 1 Drawing Sheet

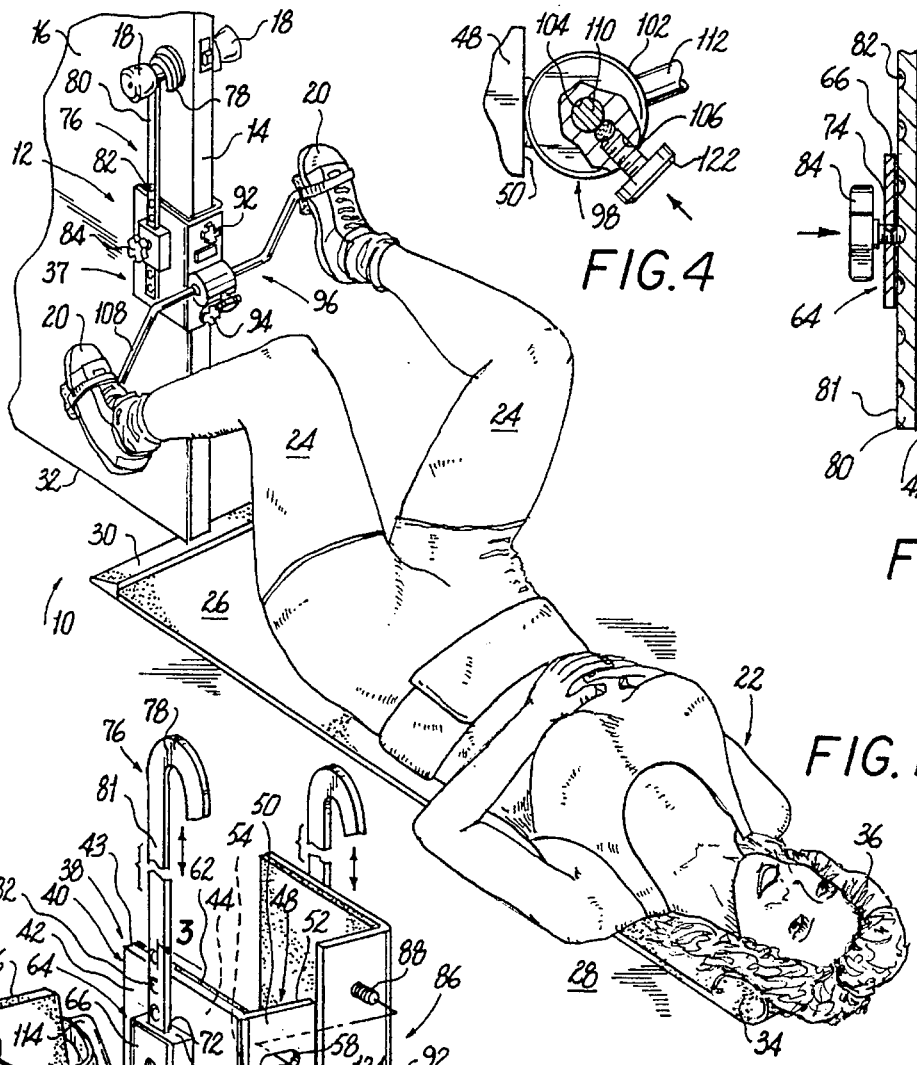
FIG. 1
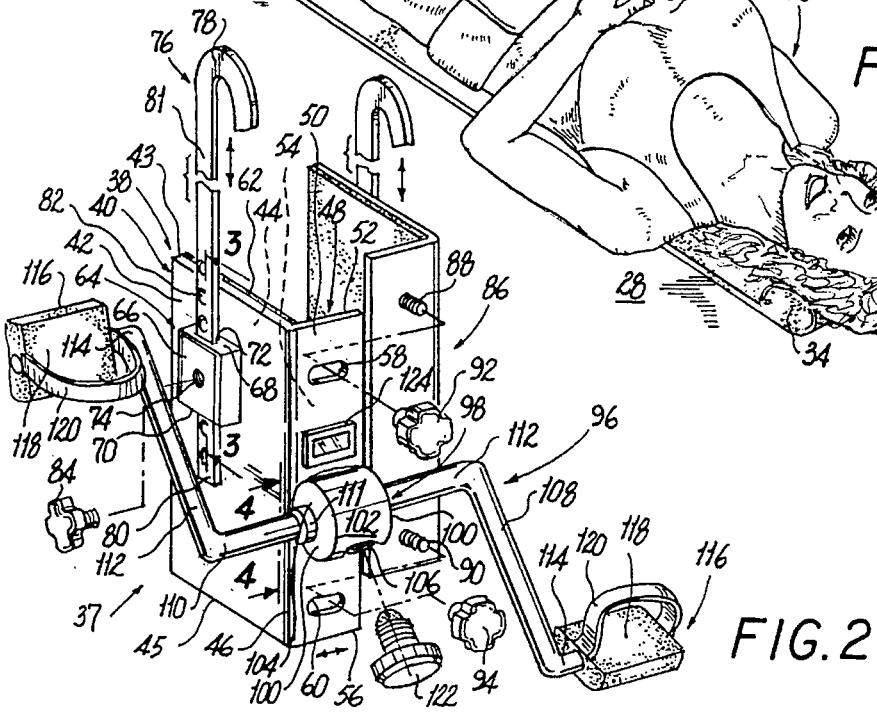
FIG. 2
FIG. 4
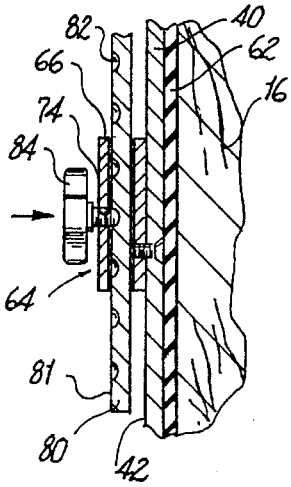
FIG. 3

EXERCISE LEG DEVICE

BACKGROUND OF THE INVENTION

The present invention relates to a leg exercise device. More particularly, the present invention relates to a leg exercise device that is replaceably attachable to an open door that includes a first generally L-shaped assembly abuttable against a first side of the open door and a free vertical edge of the open door, a second generally L-shaped assembly, abuttable against a second opposing side of the open door and overlapping a part of the first generally L-shaped assembly, width maintaining apparatus to maintain the first generally L-shaped assembly abuttable against the first side of the open door and the second generally L-shaped assembly abuttable against the second opposing side of the open door, a first flat, vertically-oriented, forwardly-facing, and inverted J-shaped height adjusting arm hookable on, and suspendable from, a doorknob on the first side of the open door, first height maintaining apparatus to maintain the first generally L-shaped assembly a predetermined distance below the doorknob on the first side of the open door, a second flat, vertically-oriented, forwardly-facing, and inverted J-shaded height adjusting arm hookable on, and suspendable from, a doorknob on the second opposing side of the open door, second height maintaining apparatus to maintain the second generally L-shaped assembly a predetermined distance below the doorknob on the second opposing side of the open door, and a pedal assembly rotatively attached to the second generally L-shaped assembly.

Physical fitness has long been a goal of many individuals of all ages and socio-economic strata. It is well recognized that the human body needs a certain amount of physical activity and exercise to function properly.

Many simple exercises are done on a routine basis and include walking, jogging, sit-ups, push-ups, and stretching exercises. Most can De done at home and at any time of the day that is convenient. The fitness enthusiast will have a set routine which is strictly followed. Many exercises require no special equipment or facility. There are some fitness enthusiasts, however, who feel the need for various home exercise devices which have appeared on the market in recent years. The devices are many and varied.

Many types of exercise devises are known for exercising different muscles groups of the human body. Most exercise devices, however, are large and heavy, preventing them from being readily moved from one room to another, or from being easily stored. Such exercise devices are typically complicated and expensive as well.

It is also difficult for fitness enthusiasts who travel for work or pleasure to have ready access to fitness equipment when they are staying away from home. Although several types of portable fitness equipment are known, these devices are typically not sufficiently small or lightweight to be readily carried from one place to another. Also, most portable devices have a number of component parts which have the disadvantage of either requiring assembly or wearing out.

Numerous innovations for door related exercise devices have been provided in the prior art that will be described. Even though these innovations may be suitable for the specific individual purposes to which they address, however, they differ from the present invention in that they do not teach a leg exercise device that is replaceably attachable to an open door that includes a first generally L-shaped assembly abuttable against a first side of the open door and a free vertical edge of the open door, a second generally L-shaped assembly, abuttable against a second opposing side of the open door and overlapping a part of the first generally L-shaped assembly, width maintaining apparatus to maintain the first generally L-shaped assembly abuttable against the first side of the open door and the second generally L-shaped assembly abuttable against the second opposing side of the open door, a first flat, vertically-oriented, forwardly-facing, and inverted J-shaped height adjusting arm hookable on, and suspendable from, a doorknob on the first side of the open door, first height maintaining apparatus to maintain the first generally L-shaped assembly a predetermined distance below the doorknob on the first side of the open door, a second flat, vertically-oriented, forwardly-facing, and inverted J-shaped height adjusting arm hookable on, and suspendable from, a doorknob on the second opposing side of the open door, second height maintaining apparatus to maintain the second generally L-shaped assembly a predetermined distance below the doorknob on the second opposing side of the open door, and a pedal assembly rotatively attached to the second generally L-shaped assembly.

FOR EXAMPLE, U.S. Pat. No. 5,163,889 to Kaaua teaches a compact, portable foot/hand hold device used to perform sit-up, leg-raise, and other type exercises with the help of any ordinary, interior, walk-through door. The device has two modes, namely, "assembled" and "stored/travel". In the "assembled" mode, the device provides a secure, comfortable foot and hand hold for the user while performing several type exercises. Constructed of three simple parts, namely, an anchor, a connecting line, and a foot/hand bar, the device assemblies in seconds. It is secured to the door by the anchor. For sit-up type exercises the user places his feet behind the foot/hand bar, one on each side of the connecting line, so that the bar is resting snugly, but comfortably, in the hollows above the insteps of the feet. His feet are necessarily positioned such that the heels are resting on the floor and the balls of his feet are pressed firmly against the vertical plane of the door. For leg-raise type exercises, the user holds the foot/hand bar in both hands while lying on his back with his arms fully extended above his head. In the preferred embodiment of the device, the connecting line is originally and permanently adjusted to fit the user's own foot (size) while wearing athletic shoes. In the "stored/travel" mode, the device is completely compact and totally portable, the purpose being a minimum of space and weight.

ANOTHER EXAMPLE, U.S. Pat. No. 5,186,698 to Mason et al. teaches a system utilizable by a patient engaged in strengthening, stretching, or range of motion exercise therapy of the ankle which contains a number of interactive components combinable in any one of several different configurations to provide the patient with specific ankle exercise devices. One such device provides ankle dorsiflexion and inversion/eversion strengthening exercises performed by moving the patient's foot in various directions against the elastic resistance of an elastomeric tube while the device is anchored in a door jamb. Another device provides ankle dorsiflexion, plantarflexion and inversion/eversion strengthening by exerting the foot against resistance from the patient across a strap. Yet another device provides ankle supination/pronation, toe flexion/extension, and isometric eversion exercises by performing various movements with the toes or feet to deform a towel. The final device is for stretching and ankle range of motion exercises by placing the patient's foot on a platform and rocking the platform on curved runners in various directions.

STILL ANOTHER EXAMPLE, U.S. Pat. No. 5,213,558 to Miller et al. teaches an integral exercise device made from a flexible plastic material and designed to be rolled up into a compact unit when not in use. The exercise device includes a main body portion having apertures for receiving the user's feet or other body part, a connector portion that slides underneath a stationary object such as a door, and a shoulder portion that abuts one side of the door during use. The shoulder portion opposes the forces imposed by the user during exercising to maintain the user's feet in the desired position. The main body portion of the exerciser may be positioned by the user to any desired height. A fastener retains the exerciser in its rolled-up condition for easy transportation and storage.

FINALLY, YET ANOTHER EXAMPLE, U.S. Pat. No. 5,342,274 to teaches Hunter teaches an exercise device constructed in a manner permitting its use by an individual to perform a variety of upper body and lower body exercises to strengthen and condition body muscles. The device comprises a base having a U-shaped channel dimensioned to fit onto an edge of a door, a set of arch-shaped receptacle members extending from the base, and a set of cords with handles extending from the receptacle members. The arch-shaped receptacle members and cords are used by the individual in accordance with the exercise being performed.

It is apparent that numerous innovations for door related exercise devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a leg exercise device that avoids the disadvantages of the prior art.

ANOTHER OBJECT of the present invention is to provide a leg exercise device that is simple and inexpensive to manufacture.

STILL ANOTHER OBJECT of the present invention is to provide a leg exercise device that is simple to use.

YET ANOTHER OBJECT of the present invention is to provide a leg exercise device that allows for more or less stretch of the legs.

STILL YET ANOTHER OBJECT of the present invention is to provide a leg exercise device that saves space.

YET STILL ANOTHER OBJECT of the present invention is to provide a leg exercise device that strengthens the legs.

STILL YET ANOTHER OBJECT of the present invention is to provide a leg exercise device that yields features not available from a regular exercise bicycle.

YET STILL ANOTHER OBJECT of the present invention is to provide a leg exercise device that takes up less space than a regular exercise bicycle.

STILL YET ANOTHER OBJECT of the present invention is to provide a leg exercise device that eliminates the need to dedicate space in the living room or the bedroom for a regular exercise bicycle.

YET STILL ANOTHER OBJECT of the present invention is to provide a leg exercise device that eliminates the need for a separate exercise room.

STILL YET ANOTHER OBJECT Of the present invention is to provide a leg exercise device that can be utilized by people with back or leg pain who require rehabilitation.

YET STILL ANOTHER OBJECT 0f the present invention is to provide a leg exercise device that can be utilized by people in wheelchairs.

STILL YET ANOTHER OBJECT of the present invention is to provide a leg exercise device that can be utilized by people who want to reduce the stomach and exercise the legs.

YET STILL ANOTHER OBJECT of the present invention is to provide a leg exercise device that is light and portable.

STILL YET ANOTHER OBJECT of the present invention is to provide a leg exercise device that can be put away easily when not in use.

YET STILL ANOTHER OBJECT Of the present invention is to provide a leg exercise device that can be used comfortably by tall or short people, children or elderly people.

STILL YET ANOTHER OBJECT of the present invention is to provide a leg exercise device that can change the amount of exercise by moving the exerciser closer or further from the open door.

BRIEFLY STATED, YET STILL ANOTHER OBJECT of the present invention is to provide a leg exercise device that is replaceably attachable to an open door that has a thickness, a free vertical edge, a free lower horizontal edge, a first side with a doorknob that extends outwardly therefrom and a contour, and a second opposing side that is opposite to the first side of the open door and has a doorknob that extends outwardly therefrom and a contour, the device exercises thee legs of an exerciser that has feet, a height, and a head, and includes a first generally L-shaped assembly, a second generally L-shaped assembly, width maintaining apparatus, a first flat, vertically-oriented, forwardly-facing, and inverted J-shaped height adjusting arm, first height maintaining apparatus, a second flat, vertically-oriented, forwardly-facing, and inverted J-shaped height adjusting arm, second height maintaining apparatus, and a pedal assembly.

STILL YET ANOTHER OBJECT of the present invention is to provide a leg exercise device wherein the first generally L-shaped assembly has a generally L-shaped plate with a flat, rectangular-shaped, and wide portion that is abuttable against the first side of the open door below the doorknob on the first side of the open door, and a flat rectangular-shaped, and narrow portion that is narrower than and extends perpendicularly inwardly from, the flat, rectangular-shaped, and wide portion of the generally L-shaped plate of the first generally L-shaped assembly and is abuttable against the free vertical edge of the open door.

YET STILL ANOTHER OBJECT of the present invention is to provide a leg exercise device wherein the second generally L-shaped assembly has a generally L-shaped plate with a flat, rectangular-shaped, and wide portion that is against the second opposing side of the open door below the doorknob on the second opposing side of the open door, and a flat, rectangular-shaped, and narrow portion that is narrower than, and extends perpendicularly inwardly from the flat, rectangular-shaped, and wide portion of the generally L-shaped plate of the second generally L-shaped assembly and overlaps the flat, rectangular-shaped, and narrow portion of the generally L-shaped plate of the first generally L-shaped assembly and is horizontally adjustable therewith, so that the leg exercise device can be used on open doors of different thicknesses.

STILL YET ANOTHER OBJECT of the present invention is to provide a leg exercise device wherein the maintaining apparatus maintains the overlap of the flat, rectangular-shaped, and narrow portion of the generally L-shaped plate of the second generally L-shaped assembly on the flat, rectangular-shaped, and narrow portion of the generally L-shaped plate of the first generally L-shaped assembly with the flat, rectangular-shaped, and wide portion of the generally L-shaped plate of the second generally L-shaped assembly displaced a distance from the flat, rectangular-shaped, and wide portion of the generally L-shaped plate of the first generally L-shaped assembly equal to the thickness of the open door, so that the open door is replaceably engaged therebetween.

YET STILL ANOTHER OBJECT of the present invention is to provide a leg exercise device wherein the first flat, vertically-oriented, forwardly-facing, and inverted J-shaped height adjusting arm has a forward facing hook portion that is replaceably hookable on the doorknob on the first side of the open door, and a flat and slender body portion that is vertically movably adjustably mounted to the flat, rectangular-shaped, and wide portion of the generally L-shaped plate of the first generally L-shaped assembly, so that the first generally L-shaped assembly is replaceably suspended from, and vertically adjustable below, the doorknob on the first side of the open door so as to allow for exercisers of different heights.

STILL YET ANOTHER OBJECT of the present invention is to provide a leg exercise device wherein the first height maintaining apparatus maintains the first generally L-shaped assembly a preselected vertical distance below the doorknob on the first side of the open door.

YET STILL ANOTHER OBJECT of the present invention is to provide a leg exercise device wherein the second flat, vertically-oriented, forwardly-facing, and inverted J-shaped height adjusting arm has a forward facing hook portion that is replaceably hookable on the doorknob on the second opposing side of the open door, and a flat and slender body portion that is vertically movably adjustably mounted to the flat, rectangular-shaped, and wide portion of the generally L-shaped plate of the second generally L-shaped assembly, so that the second generally L-shaped assembly is replaceably suspended from, and vertically adjustable below, the doorknob on the second opposing side of the open door so as to allow for exercisers of different heights.

STILL YET ANOTHER OBJECT of the present invention is to provide a leg exercise device wherein the second height maintaining apparatus maintains the second generally L-shaped assembly a preselected vertical distance below the doorknob on the second opposing side of the open door.

YET STILL ANOTHER OBJECT of the present invention is to provide a leg exercise device wherein the pedal assembly is attached, ached to the flat, rectangular-shaped, and narrow portion of the generally L-shaped plate of the second generally L-shaped assembly and replaceably receivers the feet of the exerciser, so that the legs of the exerciser are exercised when the pedal assembly is rotated by action of the legs of the exerciser.

STILL YET ANOTHER OBJECT of the present invention is to provide a leg exercise device wherein the flat, rectangular-shaped, and wide portion of the generally L-shaped plate of the first generally L-shaped assembly has a flat outer surface, a horizontal and straight upper edge, a flat inner surface, a horizontal and straight lower edge, and a vertical and straight front edge from which the flat, rectangular-shaped, and narrow portion of the generally L-shaped plate of the first generally L-shaped assembly extends perpendicularly inwardly along.

YET STILL ANOTHER OBJECT of the present invention is to provide a leg exercise device wherein the flat, rectangular-shaped, and wide portion of the generally L-shaped plate of the second generally L-shaped assembly has a flat outer surface, a horizontal and straight upper edge, a flat inner surface, a horizontal and straight lower edge, and a vertical and straight front edge from which the flat, rectangular-shaped, and narrow portion of the generally L-shaped plate of the second generally L-shaped assembly extends perpendicularly inwardly along.

STILL YET ANOTHER OBJECT of the present invention is to provide a leg exercise device wherein the generally L-shaped plate of the first generally L-shaped assembly and the generally L-shaped plate of the second generally L-shaped assembly are metallic.

YET STILL ANOTHER OBJECT of the present invention is to provide a leg exercise device wherein the flat, rectangular-shaped, and narrow portion of the generally L-shaped plate of the first generally L-shaped assembly has a flat outer surface that is continuous with, and extends perpendicularly inwardly from, the flat outer surface of the flat, rectangular-shaped, and wide portion of the generally L-shaped plate of the first generally L-shaped assembly.

STILL YET ANOTHER OBJECT of the present invention is to provide a leg exercise device wherein the flat, rectangular-shaped, and narrow portion of the generally L-shaped plate of the second generally L-shaped assembly has a flat outer surface that is continuous with, and extends perpendicularly inwardly from, the flat outer surface of the flat, rectangular-shaped, and wide portion of the generally L-shaped plate of the second generally L-shaped assembly.

YET STILL ANOTHER OBJECT of the present invention is to provide a leg exercise device wherein the flat, rectangular-shaped, and narrow portion of the generally L-shaped plate of the first generally L-shaped assembly further has a horizontal and straight upper edge that is continuous with, and extends perpendicularly inwardly from, the horizontal and straight upper edge of the flat, rectangular-shaped, and wide portion of the generally L-shaped plate of the first generally L-shaped assembly.

STILL YET ANOTHER OBJECT of the present invention is to provide a leg exercise device wherein the flat, rectangular-shaped, and narrow portion of the generally L-shaped plate of the second generally L-shaped assembly further has a horizontal and straight upper edge that is continuous with, and extends perpendicularly inwardly from, the horizontal and straight upper edge of the flat, rectangular-shaped, and wide portion of the generally L-shaped plate of the second generally L-shaped assembly.

YET STILL ANOTHER OBJECT of the present invention is to provide a leg exercise device wherein the flat, rectangular-shaped, and narrow portion of the generally L-shaped plate of the first generally L-shaped assembly further has a flat inner surface that is continuous with, and extends perpendicularly inwardly from, the flat inner surface of the flat, rectangular-shaped, and wide portion of the generally L-shaped plate of the first generally L-shaped assembly.

STILL YET ANOTHER OBJECT of the present invention is to provide a leg exercise device wherein the flat, rectangular-shaped, and narrow portion of the generally L-shaped plate of the second generally L-shaped assembly further has a flat inner surface that is continuous with, and extends perpendicularly inwardly from, the flat inner surface of the flat, rectangular-shaped, and wide portion of the generally L-shaped plate of the second generally L-shaped assembly.

YET STILL ANOTHER OBJECT of the present invention is to provide a leg exercise device wherein the flat, rectangular-shaped, and narrow portion of the generally L-shaped plate of the first generally L-shaped assembly further has a horizontal and straight lower edge that is continuous with, and extends perpendicularly inwardly from, the horizontal and straight lower edge of the flat, rectangular-shaped, and wide portion of the generally L-shaped plate of the first generally L-shaped assembly.

STILL YET ANOTHER OBJECT of the present invention is to provide a leg exercise device wherein the flat, rectangular-shaped, and narrow portion of the generally L-shaped plate of the second generally L-shaped assembly further has a horizontal and straight lower edge that is continuous with, and extends perpendicularly inwardly from, the horizontal and straight lower edge of the flat, rectangular-shaped, and wide portion of the generally L-shaped plate of the second generally L-shaped assembly.

YET STILL ANOTHER OBJECT of the present invention is to provide a leg exercise device wherein the width maintaining apparatus includes an upper horizontally-elongated width adjusting throughslot that extends through the flat, rectangular-shaded, and narrow portion of the generally L-shaped plate of the second generally L-shaped assembly, in proximity of, and parallel to, the horizontal and straight upper edge of the flat, rectangular-shaped, and narrow portion of the generally L-shaped plate of the second generally L-shaped assembly.

STILL YET ANOTHER OBJECT of the present invention is to provide a leg exercise device wherein the width maintaining apparatus further includes an upper externally threaded stud that extends perpendicularly outwardly from the flat, rectangular-shaped, and narrow portion of the generally L-shaped plate of the first generally L-shaped assembly, in proximity of the horizontal and straight upper edge of the flat, rectangular-shaped, and narrow portion of the generally L-shaped plate of the first generally L-shaped assembly.

YET STILL ANOTHER OBJECT of the present invention is to provide a leg exercise device wherein the upper externally threaded stud of the width maintaining apparatus freely enters into, and is horizontally movable in, the upper horizontally-elongated width adjusting throughslot in the flat, rectangular-shaped, and narrow portion of the generally L-shaped plate of the second generally L-shaped assembly.

STILL YET ANOTHER OBJECT of the present invention is to provide a leg exercise device wherein the width maintaining apparatus further includes an upper internally threaded knob that threadably engages the upper externally threaded stud of the width maintaining apparatus, so that the first generally L-shaped assembly and the second generally L-shaped assembly are prevented from separating from each other and maintained against the open door.

YET STILL ANOTHER OBJECT Of the present invention is to provide a leg exercise device wherein the width maintaining apparatus further includes a lower horizontally-elongated width adjusting throughslot that extends through the flat, rectangular-shaped, and narrow portion of the generally L-shaped plate of the second generally L-shaped assembly, in proximity of, and parallel to, the horizontal and straight lower edge of the flat, rectangular-shaped, and narrow portion of the generally L-shaped plate of the second generally L-shaped assembly.

STILL YET ANOTHER OBJECT of the present invention is to provide a leg exercise device wherein the width maintaining apparatus further includes a lower externally threaded stud that extends perpendicularly outwardly from the flat, rectangular-shaped, and narrow portion of the generally L-shaped plate of the first generally L-shaped assembly, in proximity of the horizontal and straight lower edge of the flat, rectangular-shaped, and narrow portion of the generally L-shaped plate of the first generally L-shaped assembly.

YET STILL ANOTHER OBJECT of the present invention is to provide a leg exercise devices wherein the lower externally threaded stud of the width maintaining apparatus freely enters into, and is horizontally movable in, the lower horizontally-elongated width adjusting throughslot in the flat, rectangular-shaped, and narrow portion of the generally L-shaped plate of the second generally L-shaped assembly.

STILL YET ANOTHER OBJECT of the present invention is to provide a leg exercise device wherein the width maintaining apparatus further includes a lower internally threaded knob that threadably engages the lower externally threaded stud of the width maintaining apparatus, so that the first generally L-shaped assembly and the second generally L-shaped assembly are further prevented from separating from each other and further maintained against the open door.

YET STILL ANOTHER OBJECT of the present invention is to provide a leg exercise device wherein the first generally L-shaped assembly further includes a rectangular-shaped cushion pad that is deformable and attached to, and covers entirety of, the flat inner surface of the flat, rectangular-shaped, and wide portion of the generally L-shaped plate of the first generally L-shaped assembly, so that the rectangular-shaped cushion pad of the first generally L-shaped assembly can deform to match the contour of the first side of the open door on which the generally L-shaped plate of the first generally L-shaped assembly abuts against and thereby provides a more secure fit for the generally L-shaped plate of the first generally L-shaped assembly while protecting the first side of the open door from possible damage thereto caused by the generally L-shaped plate of the first generally L-shaped assembly.

STILL YET ANOTHER OBJECT of the present invention is to provide a leg exercise device wherein the second generally L-shaped assembly further includes a rectangular-shaped cushion pad that is deformable and attached to, and covers entirety of, the flat inner surface of the flat, rectangular-shaped, and wide portion of the generally L-shaped plate of the second generally L-shaped assembly, so that the rectangular-shaped cushion pad of the second generally L-shaped assembly can deform to match the contour of the second opposing side of the open door on which the generally L-shaped plate of the second generally L-shaped assembly abuts against and thereby provides a more secure fit for the generally L-shaped plate of the second generally L-shaped assembly while protecting the second opposing side of the open door from possible damage thereto caused by the generally L-shaped plate of the second generally L-shaped assembly.

YET STILL ANOTHER OBJECT of the present invention is to provide a leg exercise device wherein the rectangular-shaped cushion pad of the first generally L-shaped assembly and the rectangular-shaped cushion pad of the second generally L-shaped assembly are cloth.

STILL YET ANOTHER OBJECT of the present invention is to provide a leg exercise device wherein the first height maintaining apparatus includes a rectangular-parallelepiped-shaped housing that is replaceably attached to the outer surface of the flat, rectangular-shaped, and wide portion of the generally L-shaped plate of the first generally L-shaped assembly and has a rectangular-shaped side with a center, a rectangular-shaped top with a center, and a rectangular-shaped bottom with a center.

YET STILL ANOTHER OBJECT of the present invention is to provide a leg exercise device wherein the second height maintaining apparatus includes a rectangular-parallelepiped-shaped housing that is replaceably attached to the outer surface of the flat, rectangular-shaped, and wide portion of the generally L-shaped plate of the second generally L-shaped assembly and has a rectangular-shaped side with a center, a rectangular-shaped top with a center, and a rectangular-shaped bottom with a center.

STILL YET ANOTHER OBJECT of the present invention is to provide a leg exercise device wherein the rectangular-parallelepiped-shaped housing of the first height maintaining apparatus has a rectangular-parallelepiped-shaped and vertically-oriented throughslot that opens into, and extends from, the center of the rectangular-shaped top of the rectangular-parallelepiped-shaped housing of the first height maintaining apparatus vertically downwardly to, and opens into, the center of the rectangular-shaped bottom of the rectangular-parallelepiped-shaped housing of the first height maintaining apparatus.

YET STILL ANOTHER OBJECT 0f the present invention is to provide a leg exercise device wherein the rectangular-parallelepiped-shaped housing of the second height maintaining apparatus has a rectangular-parallelepiped-shaped and vertically-oriented throughslot that opens into, and extends from, the center of the rectangular-shaped top of the rectangular-parallelepiped-shaped housing of the second height maintaining apparatus vertically downwardly to, and opens into, the center of the rectangular-shaped bottom of the rectangular-parallelepiped-shaped housing of the second height maintaining apparatus.

STILL YET ANOTHER OBJECT of the present invention is to provide a leg exercise device wherein the rectangular-parallelepiped-shaped housing of the first height maintaining apparatus further has a threaded throughbore that opens into, the extends from the center of the rectangular-shaped side of the rectangular-parallelepiped-shaped housing of the first height maintaining apparatus horizontally inwardly to, and opens into, the rectangular-parallelepiped-shaped and vertically-oriented throughslot in the rectangular-parallelepiped-shaped housing of the first height adjusting apparatus, so that the threaded throughbore in the center of the rectangular-shaped side of the rectangular-parallelepiped-shape housing of the first height maintaining apparatus is in communication with the rectangular-parallelepiped-shaped and vertically-oriented throughslot in the rectangular-parallelepiped-shaped housing of the first height maintaining apparatus.

YET STILL ANOTHER OBJECT of the present invention is to provide a leg exercise divide wherein the rectangular-parallelepiped-shaped housing of the second height maintaining apparatus further has a threaded throughbore that opens into, and extends from the center of the rectangular-shaped side of the rectangular-parallelepiped-shaped housing of the second height maintaining apparatus horizontally inwardly to, and opens into, the rectangular-parallelepiped-shaped and vertically-oriented throughslot in the rectangular-parallelepiped-shaped housing of the second height adjusting apparatus, so that the threaded throughbore in the center of the rectangular-shaped side of the rectangular-parallelepiped-shaped housing of the second height maintaining apparatus is in communication with the rectangular-parallelepiped-shaped and vertically-oriented throughslot in the rectangular-parallelepiped-shaped housing of the second height maintaining apparatus.

STILL YET ANOTHER OBJECT of the present invention is to provide a leg exercise device wherein the flat and slender body portion of the first flat, vertically-oriented, forwardly-facing, and inverted J-shaped height adjusting arm moves vertically in the rectangular-parallelepiped-shaped and vertically-oriented throughslot in the rectangular-parallelepiped-shaped housing of the first height maintaining apparatus.

YET STILL ANOTHER OBJECT 0f the present invention is to provide a leg exercise device wherein the flat and slender body portion of the second flat, vertically-oriented, forwardly-facing, and inverted J-shaped height adjusting arm moves vertically in the rectangular-parallelepiped-shaped and vertically-oriented throughslot in the rectangular-parallelepiped-shaped housing of the second height maintaining apparatus.

STILL YET ANOTHER OBJECT of the present invention is to provide a leg exercise device wherein the flat and slender body portion of the first flat, vertically-oriented, forwardly-facing, and inverted J-shaped height adjusting arm has an outer surface with a plurality of vertically spaced-apart detents therealong.

YET STILL ANOTHER OBJECT of the present invention is to provide a leg exercise device wherein the flat and slender body portion of the second flat, vertically-oriented, forwardly-facing, and inverted J-shaped height adjusting arm has an outer surface with a plurality of Vertically spaced-apart detents therealong.

STILL YET ANOTHER OBJECT of the present invention is to provide a leg exercise device wherein the first height maintaining apparatus further includes an externally threaded knob that threadably engages the threaded throughbore in the center of the rectangular-shaped side of the rectangular-parallelepiped-shaped housing of the first height maintaining apparatus, and abuts snugly in a selected detent of the plurality of spaced-apart and vertically oriented detents in the flat outer surface of the flat and slender body portion of the first flat, vertically-oriented, forwardly-facing, and inverted J-shaped height adjusting arm, so that the first generally L-shaped assembly can be maintained a comfortable distance below the doorknob on the first side of the open door which is dependent upon the height of the exerciser.

YET STILL ANOTHER OBJECT of the present invention is to provide a leg exercise device wherein the second height maintaining apparatus further includes an externally threaded knob that threadably engages the threaded throughbore in the center of the rectangular-shaped side of the rectangular-parallelepiped-shaped housing of the second height maintaining apparatus, and abuts snugly in a selected detent of the plurality of spaced-apart and vertically oriented detents in the flat outer surface of the flat and slender body portion of the second flat, vertically-oriented, forwardly-facing, and inverted J-shaped height adjusting arm, so that the second generally L-shaped assembly can be maintained a comfortable distance below the doorknob on the second opposing side of the open door which is dependent upon the height of the exerciser.

STILL YET ANOTHER OBJECT of the present invention is to provide a leg exercise device wherein the pedal assembly includes a circular-cylindrically-shaped and horizontally-oriented housing that is welded horizontally, at a circular-cylindrically-shaped longitudinal side thereof, to the flat outer surface of the flat, rectangular-shaped, and narrow portion of the generally L-shaped plate of the second generally L-shaped assembly, between the upper horizontally-elongated width adjusting throughslot in the flat, rectangular-shaped, and narrow portion of the generally L-shaped plate of the second generally L-shaped assembly and the lower horizontally-elongated width adjusting throughslot in the flat, rectangular shaped, and narrow portion of the generally L-shaped plate of the second generally L-shaped assembly.

YET STILL ANOTHER OBJECT of the present invention is to provide a leg exercise device wherein the circular-cylindrically-shaped and horizontally-oriented housing of the pedal assembly further has a pair of ends, a horizontal throughbore that extends longitudinally therethrough and opens into the pair of ends of the circular-cylindrically-shaped and horizontally-oriented housing of the pedal assembly, and a threaded and radially-oriented throughbore that extends radially inwardly from, and opens into, an accessible portion of the circular-cylindrically-shaped longitudinal side of the circular -cylindrically-shaped and horizontally-oriented housing of the pedal assembly to, and opens into, the horizontal throughbore in the circular-cylindrically-shaped and horizontally-oriented housing of the pedal assembly, so that the threaded and radially-oriented throughbore in the circular-cylindrically-shaped add horizontally-oriented housing of the pedal assembly is in communication with the horizontal throughbore in the circular-cylindrically-shaped and horizontally-oriented housing of the pedal assembly.

STILL YET ANOTHER OBJECT of the present invention is to provide a leg exercise device wherein the pedal assembly further includes a substantially Z-shaped crank with square bends that has an elongated, slender, and cylindrically-shaped intermediate portion that is rotatively mounted, at a center thereof, in the horizontal throughbore in the circular-cylindrically-shaped and horizontally-oriented housing of the pedal assembly, with bearings therebetween.

YET STILL ANOTHER OBJECT of the present invention is to provide a leg exercise device wherein the pedal assembly substantially Z-shaped crank with square bends of the pedal assembly further has a pair of parallel, elongated, slender, and cylindrically-shaped end portions.

STILL YET ANOTHER OBJECT of the present invention is to provide a leg exercise device wherein each end portion of the pair of parallel, elongated, slender, and cylindrically-shaped end portions of the substantially Z-shaped crank with square bends of the pedal assembly extends perpendicularly outwardly from an end of the elongated, slender, and cylindrically-shaped intermediate portion of the substantially Z-shaped crank with square bends of the pedal assembly, in opposite directions from each other, and has a free end.

YET STILL ANOTHER OBJECT of the present invention is to provide a leg exercise device wherein the free end of each end portion of the pair of parallel, elongated, slender, and cylindrically-shaped end portions of the substantially Z-shaped crank with square bends of the pedal assembly has rotatively disposed thereon, a foot pedal sub-assembly that is rotatable on an axis parallel to the elongated, slender, and cylindrically-shaped intermediate portion of the substantially Z-shaped crank with square bends of the pedal assembly.

STILL YET ANOTHER OBJECT of the present invention is to provide a leg exercise device wherein each foot pedal sub-assembly of the pedal assembly includes a pedal that is rotatively attached to the free end of each end portion of the pair of parallel, elongated, slender, and cylindrically-shaped end portions of the substantially Z-shaped crank with square bends of the pedal assembly, so that the feet of the legs of the exerciser can rest thereon during exercising, and an elastic strap that is attached at ends thereof to the pedal of each foot pedal sub-assembly of the pedal assembly, so that the feet of the legs of the exerciser can be releasably maintained in each foot pedal sub-assembly of the pedal assembly.

YET STILL ANOTHER OBJECT of the present invention is to provide a leg exercise device wherein the pedal assembly further includes an externally threaded tension adjusting knob that threadably engages the threaded and radially-oriented throughbore in the circular-cylindrically-shaped and horizontally-oriented housing of the pedal assembly, and abuts with selective tension against, the center of the elongated, slender, and cylindrically-shaped intermediate portion of the substantially Z-shaped crank with square bends of the pedal assembly, so that amount of resistance applied to the pedal assembly can be varied.

STILL YET ANOTHER OBJECT of the present invention is to provide a leg exercise device that further includes an electronic timing device disposed on the flat outer surface of the flat, rectangular-shaped, and narrow position of the generally L-shaped plate of the second generally L-shaped assembly, between the upper horizontally-elongated width adjusting throughslot in the flat, rectangular-shaped, and narrow portion of the generally L-shaped plate of the second generally L-shaped assembly and the circular-cylindrically-shaped and horizontally-oriented housing of the pedal assembly, so that she electronic timing device is easily visible during exercising so as to allow length of a workout to be easily monitored.

YET STILL ANOTHER OBJECT of the present invention is to provide a leg exercise device wherein the electronic timing device has an alarm that can be preset to sound when a preselected workout time has been reached.

STILL YET ANOTHER OBJECT of the present invention is to provide a leg exercise device that further includes a floor pad positionable on a floor, so that the exerciser can rest comfortably thereon during exercising.

YET STILL ANOTHER OBJECT of the present invention is to provide a leg exercise device wherein the floor pad has a wedge shaped door stop end that is wedgable between the free lower horizontal edge of the open door and the floor, so that the open door is maintained in an open position, and a head rest end, so that the head of the exerciser can comfortably rest thereon during exercising.

STILL YET ANOTHER OBJECT of the present invention is to provide a method of utilizing a leg exercise device that is replaceably attachable to an open door having a free lower horizontal edge, a thickness, a first side with a doorknob extending therefrom, and a second opposing side with a doorknob extending therefrom and being opposite to the first side of the open door, and includes the steps of opening the door; positioning a floor pad of the leg exercise device on a floor, inline with the open door; wedging a wedge shaped door stop end of the floor pad between the free lower horizontal edge of the open door and the floor, so that the open door in maintained in an open position; loosening an upper internally threaded width maintaining knob of the leg exercise device, so that the leg exercise device can be adjusted to the thickness of the open door; loosening a lower internally threaded width maintaining knob of the leg exercise device, to that the leg exercise device can be further adjusted to the thickness of the open door; moving a first generally L-shaped assembly of the leg exercise device and a second generally L-shaped assembly of the leg exercise device relative to each other, to that the leg exercise device can be further adjusted to thee thickness of the open door; straddling the free vertical edge of the open door with the first generally L-shaped assembly and the second generally L-shaped assembly, so that the leg exercise device is positioned on the open door; hooking a forward-facing hook portion of a first flat, vertically-oriented, forwardly-facing, and inverted J-shaped height adjusting arm of the leg exercise device onto the doorknob on the first side of the open Moor, so that the leg exercise device is suspended from the doorknob on the first side of the open door; hooking a forward-facing hook portion of a second flat, vertically-oriented, forwardly-facing, and inverted J-shaped height adjusting arm of the leg exercise device onto the doorknob on the second opposing side of the open door, so that the leg exercise device is further suspended from the doorknob on the second opposing side of the open door; loosening an externally threaded knob of the first generally L-shaped assembly, so that the leg exercise device can be adjusted to a comfortable vertical position on the first side of the open door which is dependent upon height of an exerciser; loosening an externally threaded knob of the second generally L-shaped assembly, so that the leg exercise device can be further adjusted to a comfortable vertical position on the second opposing side of the open door which is dependent upon the height of the exerciser; sliding the first generally L-shaped assembly vertically along a flat and slender body portion of the first flat, vertically-oriented, forwardly-facing, and inverted J-shaped height adjusting arm to the comfortable vertical position on the first side of the open door, so that the leg exercise device is adjusted to the comfortable vertical position on the first side of the open door; sliding the second generally L-shaped assembly vertically along a flat and slender body portion of the second flat, vertically-oriented, forwardly-facing, and inverted J-shaped height adjusting arm to the comfortable vertical position on the second opposing side of the open door, so that the leg exercise device is further adjusted to the comfortable vertical position on the second opposing side of the open door; tightening the externally threaded knob of the first generally L-shaped assembly until it engages snugly in an appropriate detent of a plurality of vertically spaced-apart detents in a flat outer surface of the flat and slender body portion of the first flat, vertically-oriented, forwardly-facing, and inverted J-shaped height adjusting arm, so that the leg exercise device is maintained at the comfortable vertical position on the first side of the open door; tightening the externally threaded knob of the second generally L-shaped assembly until it engages snugly in an appropriate detent of a plurality of vertically spaced-apart detents in a flat outer surface of the flat and slender body portion of the second flat, vertically-oriented, forwardly-facing, and inverted J-shaped height adjusting arm, so that the leg exercise device is further maintained at the comfortable vertical position on the second opposing side of the open door; moving the first generally L-shaped assembly and the second generally L-shaped assembly relative to each other until the first generally L-shaped assembly abuts against the first side of the open door and the free vertical edge of the open door, and the second generally L-shaped assembly abuts against the second opposing side of the open door and overlaps a part of the second generally L-shaped assembly, so that the leg exercise device is adjusted to the thickness of the open door; tightening the upper internally threaded width maintaining knob, so that the leg exercise device is maintained at the thickness of the open door; tightening the lower internally threaded width maintaining knob, so that the leg exercise device is further maintained at the thickness of the open door; lying the exerciser down on the floor pad with a head of the exerciser resting comfortably on a head rest end of the floor pad, so that the exerciser can comfortably exercise; engaging each foot of feet of legs of the exerciser in each foot pedal sub-assembly of a pedal assembly of the leg exercise device, so that the feet of the legs of the exerciser straddle the open door; and, rotating a substantially Z-shaped crank with square bends of the pedal assembly, so that the legs of the exerciser are being exercised.

YET STILL ANOTHER OBJECT of the present invention is to provide a method of utilizing a leg exercise device that further includes the step of varying the distance that a torso of the exerciser is from the open door, so that different amounts of resistance can be applied.

FINALLY, STILL YET ANOTHER OBJECT of the present invention is to provide a method of utilizing a leg exercise device that further includes the steps of threading an externally threaded tension adjusting knob relative to a threaded and radially-oriented throughbore in a circular-cylindrically-shaped and horizontally-oriented housing Of the pedal assembly; and abutting, with selective tension, the externally threaded tension adjusting knob against a center of an elongated, slender, and cylindrically-shaped intermediate portion of the substantially Z-shaped crank with square bends of the pedal assembly, so that amount of resistance applied to the pedal assembly can be varied.

The novel features which are considered characteristic of the present invention are set forth in the appended claims. The invention itself, however, both is to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the exercise portion of the present invention installed on a door and being utilized by an exerciser to exercise the legs thereof who is lying on the pad portion of the present invention;

FIG. 2 is an enlarged exploded diagrammatic perspective view of the exercise portion of the present invention;

FIG. 3 is an enlarged cross sectional view, with parts broken away, taken on line 3—3 in FIG. 2 of the vertical height adjusting assembly of the present invention; and FIG. 4 is an enlarged cross sectional view, with parts broken away, taken on line 4—4 in FIG. 2 of the resistance adjusting assembly of the present invention.

LIST OF REFERENCE NUMERALS UTILIZED IN THE DRAWING

10 leg exercise device of the present invention
12 leg exercise portion
14 open door free vertical edge
16 open door
18 open door knobs
20 exerciser feet
22 exerciser
24 exerciser legs
26 exerciser floor Dad

28 floor
30 exerciser floor pad wedge shaped door stop end
32 door free lower horizontal edge
34 exerciser floor pad head rest end
36 exerciser head
37 first generally L-shaped assembly
38 first assembly generally L-shaped plate
40 first assembly plate flat rectangular-shaped, and wide portion
42 first assembly plate wide portion flat outer surface
43 first assembly plate wide portion horizontal and straight upper edge
44 first assembly plate wide portion flat inner surface
45 first assembly plate wide portion horizontal and straight lower edge
46 first assembly plate wide portion vertical and straight front edge
48 first assembly plate flat, rectangular-shaped, and narrow portion
50 first assembly plate narrow portion flat outer surface
52 first assembly plate narrow portion horizontal and straight upper edge
54 first assembly plate narrow portion flat inner surface
56 first assembly plate narrow portion horizontal and straight lower edge
58 first assembly place narrow portion upper horizontally-elongated width adjusting throughslot
60 first assembly plate narrow portion lower horizontally-elongated width adjusting throughslot
62 first assembly plate wide portion inner surface rectangular-shaped cushion pad
64 first assembly plate wide portion outer surface rectangular-parallelepiped-shaped height adjusting housing
66 first assembly plate wide portion outer surface height adjusting housing rectangular-shaped side
68 first assembly plate wide portion outer surface height adjusting housing rectangular-shaped top
70 first assembly plate wide portion outer surface height adjusting housing rectangular-shaped bottom
72 first assembly plate wide portion outer surface height adjusting housing rectangular-parallelepiped-shaped and vertically-oriented throughslot
74 first assembly plate wide portion outer surface height adjusting housing horizontally-oriented and threaded throughbore
76 first assembly flat, vertically-oriented, forwardly-facing, and inverted J-shaped height adjusting arm
78 first assembly height adjusting arm forward-facing upper door knob hook portion
80 first assembly height adjusting arm flat and slender body portion
81 first assembly height adjusting arm body portion flat outer surface
82 first assembly height adjusting arm body portion outer surface plurality of spaced-apart and vertically-oriented detents
84 first assembly height adjusting arm externally threaded knob
86 second generally L-shaped assembly
88 second assembly plate narrow portion upper perpendicularly-outwardly-extending threaded stud
90 second assembly plate narrow portion lower perpendicularly-outwardly-extending threaded stud
92 plate assembly upper internally threaded width maintaining knob
94 plate assembly lower internally threaded width maintaining knob
96 pedal assembly
98 pedal assembly circular-cylindrically-shaped and horizontally-oriented housing
100 pedal assembly housing pair of ends
102 pedal assembly housing circular-cylindrically-shaped longitudinal side
104 pedal assembly housing horizontal throughbore
106 pedal assembly housing threaded and radially-oriented throughbore
108 pedal assembly substantially Z-shaped crank with square bends
110 pedal assembly crank elongated, slender, and cylindrically-shaped intermediate portion
111 pedal assembly bearings
112 pedal assembly crank pair of parallel, elongated, slender, and cylindrically-shaped end portions
114 pedal assembly crank end portion free end
116 pedal assembly foot pedal sub-assembly
118 pedal assembly foot pedal sub-assembly pedal
120 pedal assembly foot pedal sub-assembly elastic strap
122 pedal assembly crank externally threaded tension adjusting knob
124 electronic timing device

DETAILED DESCRIPTION OF THE PREFERRED EMBODIMENT

Referring now to the figures in which like numerals indicate like parts, and particularly to FIG. 1, which is a diagrammatic perspective view of the present invention installed on a door and being utilized by an exerciser to exercise the legs thereof, the leg exercise device of the present invention is shown generally at 10 and includes a leg exercise portion 12 replaceably and horizontally adjustably attached to an open door free vertical edge 14 of an open door 16 and replaceably and vertically adjustably suspended from open door knobs 18 of the open door 16 and replaceably receiving exerciser feet 20 of an exerciser 22 who is exercising exerciser legs 24 of the exerciser 22 while the exerciser 22 lies comfortably on an exerciser floor pad 26 on a floor 28 and which has an exerciser floor pad wedge shaped door stop end 30 that is wedged between a door free lower horizontal edge 32 of the open door 16 and the floor 28 for maintaining the open door 16 in an open position and an exerciser floor pad head rest end 34 for comfortably supporting an exerciser head 36 of the exerciser 22 during exercising.

The configuration of the leg exercise portion 12 can best be seen in FIG. 2, which is an enlarged exploded diagrammatic perspective view of the exercise portion of the present invention, and as such will be discussed with reference thereto.

The leg exercise portion 12 includes a first generally L-shaped assembly 37 that includes a first assembly generally L-shaped plate 38 that abuts against a side of the open door 16 and has a first assembly plate flat rectangular-shaped, and wide portion 40 with a first assembly plate wide portion flat outer surface 42, a first assembly plate wide portion horizontal and straight upper edge 43, a first assembly plate wide portion flat inner surface 44, a first assembly plate wide portion horizontal and straight lower edge 45, and a first assembly plate wide portion vertical and straight front edge 46.

The first generally L-shaped assembly 37 is preferably metallic, and the first assembly plate flat, rectangular-shaped, and wide portion 40 of the first generally L-shaped assembly 37 is preferably 7" high and 4" wide.

The first assembly generally L-shaped plate 38 of the first generally L-shaped assembly 37 further has a first assembly plate flat, rectangular-shaped, and narrow portion 48 that extends perpendicularly inwardly along the first assembly plate wide portion vertical and straight front edge 46 of the first assembly plate flat, rectangular-shaped, and wide portion 40 of the first assembly generally L-shaped plate 38 of the first generally L-shaped assembly 37, and is narrower than the first assembly plate flat, rectangular-shaped, and wide portion 40 of the first assembly generally L-shaped plate 38 of the first generally L-shaped assembly 37.

The first assembly plate flat, rectangular-shaped, and narrow portion 48 of the first assembly generally L-shaped plate 38 of the first generally L-shaped assembly 37 has a first assembly plate narrow portion flat outer surface 50 that is continuous with, and extends perpendicularly inwardly from, the first assembly plate wide portion flat outer surface 42 of the first assembly plate flat, rectangular-shaped, and wide portion 40 of the first assembly generally L-shaped plate 38 of the first generally L-shaped assembly 37.

The first assembly plate flat, rectangular-shaped, and narrow portion 48 of the first assembly generally L-shaped plate 38 of the first generally L-shaped assembly 37 further has a first assembly plate narrow portion horizontal and straight upper edge 52 that is continuous with, and extends perpendicularly inwardly from, the first assembly plate wide portion horizontal and straight upper edge 43 of the first assembly plate flat, rectangular-shaped, and wide portion 40 of the first assembly generally L-shaped plate 38 of the first generally L-shaped assembly 37.

The first assembly plate flat, rectangular-shaped, and narrow portion 48 of the first assembly generally L-shaped plate 38 of the first generally L-shaped assembly 37 further has a first assembly plate narrow portion flat inner surface 54 that is continuous with, and extends perpendicularly inwardly from, the first assembly plate wide portion flat inner surface 44 of the first assembly plate flat, rectangular-shaped, and wide portion 40 of the first assembly generally L-shaped plate 38 of the first generally L-shaped assembly 37.

The first assembly plate flat, rectangular-shaped, and narrow portion 48 of the first assembly generally L-shaped plate 38 of the first generally L-shaped assembly 37 further has a first assembly plate narrow portion horizontal and straight lower edge 56 that is continuous with, and extends perpendicularly inwardly from, the first assembly plate wide portion horizontal and straight lower edge 45 of the first assembly plate flat, rectangular-shaped, and wide portion 40 of the first assembly generally L-shaped plate 38 of the first generally L-shaped assembly 37.

The first assembly plate flat, rectangular-shaped, and narrow portion 48 of the first assembly generally L-shaped plate 38 of the first generally L-shaped assembly 37 further has a first assembly plate narrow portion upper horizontally-elongated width adjusting throughslot 58 that extends therethrough, in proximity of, and parallel to, the first assembly plate narrow portion horizontal and straight upper edge 52 of the first assembly plate flat, rectangular-shaped, and narrow portion 48 of the first assembly generally L-shaped plate 38 of the first generally L-shaped assembly 37.

The first assembly plate flat, rectangular-shaped, and narrow portion 48 of the first assembly generally L-shaped plate 38 of the first generally L-shaped assembly 37 further has a first assembly plate narrow portion lower horizontally-elongated width adjusting throughslot 60 that extends therethrough, in proximity of, and parallel to, the first assembly plate narrow portion horizontal and straight lower edge 56 of the first assembly plate flat, rectangular-shaped, and narrow portion 48 of the first assembly generally L-shaped plate 38 of the first generally L-shaped assembly 37.

The first assembly plate narrow portion upper horizontally-elongated width adjusting throughslot 58 in the first assembly plate flat, rectangular-shaped, and narrow portion 48 of the first assembly generally L-shaped plate 38 of the first generally L-shaped assembly 37 and the first assembly plate narrow portion lower horizontally-elongated width adjusting throughslot 60 in the first assembly plate flat, rectangular-shaped, and narrow portion 48 of the first assembly generally L-shaped plate 38 of the first generally L-shaped assembly 37 are 1" long so as to permit the leg exercise portion 12 to fit the open door 16 having a width from 1.33" to 2".

The first generally L-shape assembly 37 further includes a first assembly plate wide portion inner surface rectangular-shaped cushion pad 62 that is deformable and attached to, and covers the entirety of, the first assembly plate wide portion flat inner surface 44 of the first assembly plate flat, rectangular-shaped, and wide portion 40 of the first assembly generally L-shaped plate 38 of the first generally L-shaped assembly 37, so that the first assembly plate wide portion inner surface rectangular-shaped cushion pad 62 of the first generally L-shaped assembly 37 can deform to match the contour of a side of the open door 16 on which the first assembly generally L-shaped plate 38 of the first generally L-shaped assembly 37 abuts against and thereby provide a more secure fit for the first assembly generally L-shaped plate 38 of the first generally L-shaped assembly 37 while protecting the side of the open door 16 from possible damage thereto caused by the first assembly generally L-shaped plate 38 of the first generally L-shaped assembly 37.

The first assembly plate wide portion inner surface rectangular-shaped cushion pad 62 of the first generally L-shaped assembly 37 is preferably cloth.

The first generally L-shaped assembly 37 further includes a first assembly plate wide portion outer surface rectangular-parallelepiped-shaped height adjusting housing 64 that is replaceably attached to the first assembly plate wide portion flat outer surface 42 of the first assembly plate flat, rectangular-shaped, and wide portion 40 of the first assembly generally L-shaped plate 38 of the first generally L-shaped assembly 37, in proximity of, and parallel to, the first assembly plate wide portion horizontal and straight upper edge 43 of the first assembly plate fiat, rectangular-shaped, and wide portion 40 of the first assembly generally L-shaped plate 38 of the first generally L-shaped assembly 37.

The first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-shaped plate 38 of the first generally L-shaped assembly 37 has a first assembly plate wide portion outer surface height adjusting housing rectangular-shaped side 66 with a center, a first assembly plate wide portion outer surface height adjusting housing rectangular-shaped top 68 with a center, and a first assembly plate wide portion outer surface height adjusting housing rectangular-shaped bottom 70 with a center.

The first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-shaped plate 38 of the first generally L-shaped assembly 37 further has a first assembly plate wide portion outer surface height adjusting housing rectangular-parallelepiped-shaped and vertically-oriented throughslot 72 that opens into, and extends from, the center of the first assembly plate wide portion outer surface height adjusting housing rectangular-shaped top 68 of the first assembly plate wide portion outer surface rectangular-parallelepiped-shaped height adjusting housing 44 of the first assembly plate wide portion flat outer surface 42 of the first assembly plate flat, rectangular-shaped, and wide portion 40 of the first assembly generally L-shaped plate 38 of the first generally L-shaped assembly 37 vertically downwardly to, and opens into, the center of the first assembly plate wide portion outer surface height adjusting housing rectangular-shaped bottom 70 of the first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-shaped plate 38 of the first generally L-shaped assembly 37.

The first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-shaped plate 38 of the first generally L-shaped assembly 37 further has a first assembly plate wide portion outer surface height adjusting housing horizontally-oriented and threaded throughbore 74 that opens into, and extends from the center of the first assembly plate wide portion outer surface height adjusting housing rectangular-shaped side 66 of the first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-shaped plate 38 of the first generally L-shaped assembly 37 horizontally inwardly to, and opens into, the first assembly plate wide portion outer surface height adjusting housing rectangular-parallelepiped-shaped and vertically-oriented throughslot 72 in the first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-shaped plate 38 of the first generally L-shaped assembly 37, so that the first assembly plate wide portion outer surface height adjusting housing horizontally-oriented and threaded throughbore 74 in the center of the first assembly plate wide portion outer surface height adjusting housing rectangular-shaped side 66 of the first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-Shaped plate 38 of the first generally L-shaped assembly 37 is in communication with the first assembly plate wide portion outer surface height adjusting housing rectangular-parallelepiped-shaped and vertically-oriented throughslot 72 in the first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-shaped plate 38 of the first generally L-shaped assembly 37.

The first generally L-shaped assembly 37 further includes a first assembly flat, vertically-oriented, forwardly-facing, and inverted J-shaped height adjusting arm 76 that has a first assembly height adjusting arm forward-facing upper door knob hook portion 78, and a first assembly height adjusting arm flat and slender body portion 80 that moves vertically in the first assembly plate wide portion outer surface height adjusting housing rectangular-parallelepiped-shaped and vertically-oriented throughslot 72 in the first assembly plate wide portion outer surface rectangular-parallelepiped-shaped height adjusting housing 64 of the first assembly plate wide portion flat outer surface 42 of the first assembly plate flat, rectangular-shaped, and wide portion 40 of the first assembly generally L-shaped plate 38 of the first generally L-shaped assembly 37, so that the first generally L-shaped assembly 37 can be suspended form the open door knobs 18 of the open door 16.

The first assembly height adjusting arm flat and slender body portion 80 of the first assembly flat, vertically-oriented, forwardly-facing, and inverted J-shaped height adjusting arm 76 of the first generally L-shaped assembly 37 has a first assembly height adjusting arm body portion flat outer surface 81 with a first assembly height adjusting arm body portion outer surface plurality of spaced-apart and vertically-oriented detents 82 thereon.

The first generally L-shaped assembly 37 further includes a first assembly height adjusting arm externally threaded knob 84 that threadably engages the first assembly plate wide portion outer surface height adjusting housing horizontally-oriented and threaded throughbore 74 in the center of the first assembly plate wide portion outer surface height adjusting housing rectangular-shaped side 66 of the first assembly plate wide portion outer surface rectangular-parallelepiped-shaped height adjusting housing 64 of the first assembly plate wide portion flat outer surface 42 of the first assembly! plate flat, rectangular-shaped, and wide portion 40 of the first assembly generally L-shaped plate 38 of the first generally L-shaped assembly 37, and abuts snugly in a selected detent of the first assembly height 28 adjusting arm body portion outer surface plurality of spaced-apart and vertically oriented detents 82 in the first assembly height adjusting arm body portion flat outer surface 81 of the first assembly height adjusting arm flat and slender body portion 80 of the first assembly flat, ! vertically-oriented, forwardly-facing, and inverted J-shaped height adjusting arm 76 of the first generally L-shaped assembly, as shown in FIG. 3, which is an enlarged cross sectional view, with parts broken away, taken on line 3—3 in FIG. 2 of the vertical height adjusting assembly of the present invention, so that the first generally L-shaped assembly 37 can be maintained a comfortable distance below the open door knobs 18 of the open door 16 which is dependent upon the height of the exerciser 22.

The leg exercise portion 12 further includes a second generally L-shaped assembly 86 that abuts against an opposing side of the open door 16 and is a mirror image of, moves horizontally against, and is partially overlapped by, the first generally L-shaped assembly 37, except that the first assembly plate narrow portion upper horizontally-elongated width adjusting throughslot 58 in the first assembly plate flat, rectangular-shaped, and narrow portion 48 of the first assembly generally L-shaped plate 38 of the first generally L-shaped assembly 37 is replaced by a second assembly plate narrow portion upper perpendicularly-outwardly-extending threaded stud 88 that freely enters into, and is horizontally movable in, the first assembly plate narrow portion upper horizontally-elongated width adjusting throughslot 58 in the first assembly plate flat, rectangular-shaped, and narrow portion 48 of the first assembly generally L-shaped plate 38 of the first generally L-shaped assembly 37, and except that the first assembly plate narrow portion lower horizontally-elongated width adjusting throughslot 60 in the first assembly plate flat, rectangular-shaped, and narrow portion 48 of the first assembly generally L-shaped plate 38 of the first generally L-shaped assembly 37 is replaced by a second assembly plate narrow portion lower perpendicularly-outwardly-extending threaded stud 90 that freely enters into, and is horizontally movable in, the first assembly plate narrow portion lower horizontally-elongated width adjusting throughslot 60 in the first assembly plate flat, rectangular-shaped, and narrow portion 48 of the first assembly generally L-shaped plate 38 of the first generally L-shaped assembly 37, so that the first generally L-shaped assembly 37 and the second generally L-shaped assembly 86 can move horizontally relative to each other and adjust for different thicknesses of the open door 16.

The leg exercise portion 12 further includes a plate assembly upper internally threaded width maintaining knob 92 that threadably engages the second assembly plate narrow portion upper perpendicularly-outwardly-extending threaded stud 88 of the second generally L-shaped assembly 86, and a plate assembly lower internally threaded width maintaining knob 94 that threadably engages the second assembly plate narrow portion lower perpendicularly-outwardly-extending threaded stud 90 of the second generally L-shaped assembly 86, so that the first generally L-shaped assembly 37 and the second generally L-shaped assembly 86 can be maintained together against the open door 16.

The leg exercise device further includes a pedal assembly 96 that includes a pedal assembly circular-cylindrically-shaped and horizontally-oriented housing 98 that is welded horizontally, at a pedal assembly housing circular-cylindrically-shaped longitudinal side 102 thereof, to the first assembly plate narrow portion flat outer surface 50 of the first assembly plate flat, rectangular-shaped, and narrow portion 48 of the first assembly generally L-shaped plate 38 of the first generally L-shaped assembly 37, between the first assembly plate narrow portion upper horizontally-elongated width adjusting throughslot 58 in the first assembly plate flat, rectangular-shaped, and narrow portion 48 of the first assembly generally L-shaped plate 38 of the first generally L-shaped assembly 37 and the first assembly plate narrow portion lower horizontally-elongated width adjusting throughslot 60 in the first assembly plate flat, rectangular-shaped, and narrow portion 48 of the first assembly generally L-shaped plate 38 of the first generally L-shaped assembly 37.

The pedal assembly circular-cylindrically-shaped and horizontally-oriented housing 98 of the pedal assembly 96 further has a pedal assembly housing pair of ends 100, a pedal assembly housing horizontal throughbore 104 that extends longitudinally therethrough and opens into the pedal assembly housing pair of ends 100 of the pedal assembly circular-cylindrically-shaped and horizontally-oriented housing 98 of the pedal assembly 96, and a pedal assembly housing threaded and radially-oriented throughbore 106 that extends radially inwardly from, and opens into, an accessible portion of the pedal assembly housing circular-cylindrically-shaped longitudinal side 102 of the pedal assembly circular-cylindrically-shaped and horizontally-oriented housing 98 of the pedal assembly 96 to, and opens into, the pedal assembly housing horizontal throughbore 104 in the pedal assembly circular-cylindrically-shaped and horizontally-oriented housing 98 of the pedal assembly 96, so 2that the pedal assembly housing threaded and radially-oriented ! throughbore 106 in the pedal assembly circular-cylindrically-shaped and horizontally-oriented housing 98 of the pedal assembly 96 is in communication with the pedal assembly housing horizontal throughbore 104 in the pedal assembly circular-cylindrically-shaped and horizontally-oriented housing 98 of the pedal assembly 96.

The pedal assembly 96 further includes a pedal assembly substantially Z-shaped crank with square bends 108 that has a pedal assembly crank elongated, slender, and cylindrically-shaped intermediate portion 110 that is rotatively mounted, at its center, in the pedal assembly housing horizontal throughbore 104 in the pedal assembly circular-cylindrically-shaped and horizontally-oriented housing 98 of the pedal assembly 96, with pedal assembly bearings 111 therebetween.

The pedal assembly substantially Z-shaped crank with square bends 108 of the pedal assembly 96 further has a pedal assembly crank pair of parallel, elongated, slender, and cylindrically-shaped end portions 112. Each end portion of the pedal assembly crank pair of parallel, elongated, slender, and cylindrically-shaped end portions 112 of the pedal assembly substantially Z-shaped crank with square bends 108 of the pedal assembly 96 extends perpendicularly outwardly from an end of the pedal assembly crank elongated, slender, and cylindrically-shaped intermediate portion 110 of the pedal assembly substantially Z-shaped crank with square bends 108 of the pedal assembly 96, in opposite directions from each other, and has a pedal assembly crank end portion free end 114.

The pedal assembly crank end portion free end 114 of each end portion of the pedal assembly crank pair of parallel, elongated, slender, and cylindrically-shaped end portions 112 of the pedal assembly substantially Z-shaped crank with square bends 108 of the pedal assembly 96 has rotatively disposed thereon, a pedal assembly foot pedal sub-assembly 116 that is rotatable on an axis parallel to the pedal assembly crank elongated, slender, and cylindrically-shaped intermediate portion 110 of the pedal assembly substantially Z-shaped crank with square bends 108 of the pedal assembly 96.

Each pedal assembly foot pedal sub-assembly 116 of the pedal assembly 96 includes a pedal assembly foot pedal sub-assembly pedal 118 that is rotatively attached to the pedal assembly crank end portion free end 114 of each end portion of the pedal assembly crank pair of parallel, elongated, slender, and cylindrically-shaped end portions 112 of the pedal assembly substantially Z-shaped crank with square bends 108 of the pedal assembly 96, so that soles of shoes of the exerciser feet 20 of the exerciser legs 24 of the exerciser 22 can rest thereon, and a pedal assembly foot pedal sub-assembly elastic strap 120 that is attached, at its ends, to the pedal assembly foot pedal sub-assembly pedal 118 of each pedal assembly foot pedal sub-assembly 116 of the pedal assembly 96, so, that the shoes of the exerciser feet 20 of the exerciser legs 24 of the exerciser 22 can be releasably maintained in each pedal assembly foot pedal sub-assembly 116 of the pedal assembly 96.

The pedal assembly further includes a pedal assembly crank externally threaded tension adjusting knob 122 that threadably engages the pedal assembly housing threaded and radially-oriented throughbore 106 in the pedal assembly circular-cylindrically-shaped and horizontally-oriented housing 98 of the pedal assembly 96, and abuts with selective tension against the center of the pedal assembly crank elongated, slender, and cylindrically-shaped intermediate portion 110 of the pedal assembly substantially Z-shaped crank with square bends 108 of the pedal assembly 96, as shown in FIG. 4, which is an enlarged cross sectional view, with parts broken away, taken on line 4—4 in FIG. 2 of the resistance adjusting assembly of the present invention, so that the amount of resistance applied to the pedal assembly 96 can be varied.

The leg exercise portion 12 further includes an electronic timing device 124 disposed on the first assembly plate narrow portion flat outer surface 50 of the first assembly plate flat, rectangular-shaped, and narrow portion 48 of the first assembly generally L-shaped plate 38 of the first generally L-shaped assembly 37, between the first assembly plate narrow portion upper horizontally-elongated width adjusting throughslot 58 in the first assembly plate flat, rectangular-shaped, and narrow portion 48 of the first assembly generally L-shaped plate 38 of the first generally L-shaped assembly 37 and the pedal assembly circular-cylindrically-shaped and horizontally-oriented housing 98 of the pedal assembly 96, so that the electronic timing device 124 is easily visible during exercising allowing the length of the workout to be easily monitored. The electronic timing device 124 can also include an alarm that can be preset to sound when the preselected workout time has been reached.

The manner of using the leg exercise device 10 can best be seen in FIG. 1, and as such will be discussed with reference thereto.

STEP 1: Open the open door 16.

STEP 2: Position the exerciser floor pad 26 on the floor 28, inline with the open door 16.

STEP 3: Wedge the exerciser floor pad wedge shaped door stop end 30 of the exerciser floor pad 26 between the door free lower horizontal edge 32 of the open door 16 and the floor 28, so that the open door 16 in maintained in an open position.

STEP 4: Loosen the plate assembly upper internally threaded width maintaining knob 92, so that the leg exercise portion 12 can be adjusted to the thickness of the open door 16.

STEP 5: Loosen the plate assembly lower internally threaded width maintaining knob 94, so that the leg exercise portion 12 can be further adjusted to the thickness of the open door 16.

STEP 6: Move the first generally L-shaped assembly 37 and the second generally L-shaped assembly 96 away from each other, so that the leg exercise portion 12 can be further adjusted to the thickness of the open door 16.

STEP 7: Straddle the open door free vertical edge 14 of the open door 16 with the first generally L-shaped assembly 37 and the second generally L-shaped assembly 96, so that the leg exercise portion 12 is positioned on the open door 16.

STEP 8: Hook the first assembly height adjusting arm forward-facing upper door knob hook portion 78 of the first assembly flat, vertically-oriented, forwardly-facing, and inverted J-shaped height adjusting arm 76 of the first generally L-shaped assembly 37 onto one knob of the open door knobs 18 of the open door 16, so that the leg exercise portion 12 is positioned on the one knob of the open door knobs 18 of the open door 16.

STEP 9: Hook the second assembly height adjusting arm forward-facing upper door knob hook portion (not shown) of the second assembly flat, vertically-oriented, forwardly-facing, and inverted J-shaped height adjusting arm (not shown) of the second generally L-shaped assembly 96 onto the other knob of the open door knobs 18 of the open door 16, so that the leg exercise portion 12 is positioned on the other knob of the open door knobs 18 of the open door 16.

STEP 10: Loosen the first assembly height adjusting arm externally threaded knob 84 of the first generally L-shaped assembly 37, so that the leg exercise portion 12 can be adjusted to the comfortable vertical position on the one side of the open door 16 which is dependent upon the height of the exerciser 22.

STEP 11: Loosen the second assembly height adjusting arm externally threaded knob (not shown) of the second generally L-shaped assembly 96, so that the leg exercise portion 12 can be further adjusted to the comfortable vertical position on the other side of the open door 16 which is dependent upon the height of the exerciser 22.

STEP 12: Slide the first generally L-shaped assembly 37 vertically along the first assembly height adjusting arm flat and slender body portion 80 of the first assembly flat, vertically-oriented, forwardly-facing, and inverted J-shaped height adjusting arm 76 of the first generally L-shaped assembly 37 to the desired vertical position on the one side of the open door 16, so that the leg exercise portion 12 is adjusted to the desired vertical position on the one side of the open door 16.

STEP 13: Slide simultaneously the second generally L-shaped assembly (not shown) vertically along the second assembly height adjusting arm flat and slender body portion (not shown) of the second assembly flat, vertically-oriented, forwardly-facing, and inverted J-shaped height adjusting arm (not shown) of the second generally L-shaped assembly 96 to the desired vertical position on the other side of the open door 16, so that the leg exercise portion 12 is further adjusted to the desired vertical position on the other side of the open door 16.

STEP 14: Tighten the first assembly height adjusting arm externally threaded knob 84 of the first generally L-shaped assembly 37 until it engages snugly in an appropriate detent of the first assembly height adjusting arm body portion outer surface plurality of spaced-apart and vertically oriented detents 82 in the first assembly height adjusting arm body portion flat outer surface 81 of the first assembly height adjusting arm flat and slender body portion 80 of the first assembly flat, vertically-oriented, forwardly-facing, and inverted J-shaped height adjusting arm 76 of the first generally L-shaped assembly 37, so that the leg exercise portion 12 is maintained at the comfortable vertical position on the one side of the open door 16 which is dependent upon the height of the exerciser 22.

STEP 15: Tighten the second assembly height adjusting arm externally threaded knob (not shown) of the second generally L-shaped assembly (not shown) until it engages snugly in an appropriate detent of the second assembly height adjusting arm body portion outer surface plurality of spaced-apart and vertically oriented detents (not shown) in the second assembly height adjusting arm body portion flat outer surface (not shown) of the second assembly height adjusting arm flat and slender body portion (not shown) of the second assembly flat, vertically-oriented, forwardly-facing, and inverted J-shaped height adjusting arm (not shown) of the second generally L-shaped assembly 96, so that the leg exercise portion 12 is further maintained at the comfortable vertical position on the other side of the open door 16 which is dependent upon the height of the exerciser 22.

STEP 16: Move the first generally L-shaped assembly 37 and the second generally L-shaped assembly 96 toward each other until the second generally L-shaped assembly 96 abuts against the other side of the open door 16 and the open door free vertical edge 14 of the open door 16, and the first generally L-shaped assembly 37 abuts against the one side of the open door 16 and overlaps a part of the second generally L-shaped assembly 96, so that the leg exercise portion 12 is adjusted to the thickness of the open door 16.

STEP 17: Tighten the plate assembly upper internally threaded width maintaining knob 92, so that the leg exercise portion 12 is maintained at the thickness of the open door 16.

STEP 18: Tighten the plate assembly lower internally threaded width maintaining knob 94, so that the leg exercise portion 12 is further maintained at the thickness of the open door 16.

STEP 19: Lie down the exerciser 22 on the exerciser floor pad 26 with the exerciser head 36 of the exerciser 22 resting comfortably on the exerciser floor pad head rest end 34 the exerciser floor pad 26, so that the exerciser 22 can comfortably exercise.

STEP 20: Engage each foot of the exerciser feet 20 of the exerciser legs 24 of the exerciser 22 in each pedal assembly foot pedal sub-assembly 116 of the pedal assembly 96, so that the exerciser feet 20 of the exerciser legs 24 of the exerciser 22 straddle the open door 16.

STEP 21: Rotate the pedal assembly substantially Z-shaped crank with square bends 108 of the pedal assembly 96, so that the exerciser legs 24 of the exerciser 22 are being exercised. It is to be understood that different amount of exercise can be applied to the exerciser 22 by moving the exerciser 22 closer or further from the open door 16.

It is to be understood that the configurations of the components of the leg exercise device 10 are not merely a matter of design choice but are significant and of critical importance for, inter alia, the functions that they accomplish as discussed, supra, and any not explicitly expressed, but inherent thereto. They therefore must be considered in determining patentability. Support for this assertion can be found in In re Dailey et al., 149 U.S.P.Q. 47 (CCPA 1976), where the Court held that the shape of a device must be considered in determining patentability, if the shape is significant:

"... the configuration of the container is a 'mere matter of choice' not significantly novel . . . , [since] . . . Appellants have provided no argument which convinces us that the particular configuration of their container is significant . . . "[Emphasis added]

It will be understood that each of the elements described above, or two or more together, may also find a useful application in other types of constructions differing from the types described above.

While the invention has been illustrated and described as embodied in a leg exercise device, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A leg exercise device replaceably attachable to an open door having a thickness, a free vertical edge, a free lower horizontal edge, a first side with a doorknob extending outwardly therefrom and a contour, and a second opposing side being opposite to the first side of the open door and having a doorknob extending outwardly therefrom and a contour, said device exercising the legs of an exerciser having feet, a height, and a head, comprising:

a) a first generally L-shaped assembly having a generally L-shaped plate with a flat, rectangular-shaped, and wide portion abuttable against the first side of the open door below the doorknob on the first side of the open door, and a flat, rectangular-shaped, and narrow portion being narrower than, and extending perpendicularly inwardly from, said flat, rectangular shaped, and wide portion of said generally L-shaped plate of said first generally L-shaped assembly and being abuttable against the free vertical edge of the open door;

b) a second generally L-shaped assembly having a generally L-shaped plate with a flat, rectangular-shaped, and wide portion abuttable against the second opposing side of the open door below the doorknob on the second opposing side of the open door, and a flat, rectangular-shaped, and narrow portion being narrower than, and extending perpendicularly inwardly from said flat, rectangular-shaped, and wide portion of said generally L-shaped plate of said second generally L-shaped assembly and overlapping said flat, rectangular-shaped, and narrow portion of said generally L-shaped plate of said first generally L-shaped assembly and being horizontally adjustable therewith, so that said leg exercise device can be used on open doors of different thicknesses;

c) width maintaining means for maintaining said overlap of said flat, rectangular-shaped, and narrow portion of said generally L-shaped plate of said second generally L-shaped assembly on said flat, rectangular-shaped, and narrow portion of said generally L-shaped plate of said first generally L-shaped assembly with said flat, rectangular-shaped, and wide portion of said generally L-shaped plate of said second generally L-shaped assembly being displaced a distance from said flat, rectangular-shaped, and wide portion of said generally L-shaped plate of said first generally L-shaped assembly equal to the thickness of the open door, so that the open door is replaceably engaged therebetween;

d) a first flat, vertically-oriented, forwardly-facing, and inverted J-shaped height adjusting arm having a forward facing hook portion being replaceably hookable on the doorknob of the first side of the open door, and a flat and slender body portion being vertically movably adjustably mounted to said flat, rectangular-shaped, and wide portion of said generally L-shaped plate of said first generally L-shaped assembly, so that said first generally L-shaped assembly is replaceably suspended from, and vertically adjustable below, the doorknob on the first side of the open door so as to allow for exercisers of different heights;

e) first height maintaining means for maintaining said first generally L-shaped assembly a preselected vertical distance below the doorknob on the first side of the open door;

f) a second flat, vertically-oriented, forwardly-facing, and inverted J-shaped height adjusting arm having a forward facing hook portion being replaceably hookable on the doorknob of the second opposing side of the open door, and a flat and slender body portion being vertically movably adjustably mounted to said flat, rectangular-shape, and wide portion of the generally L-shaped plate of the second generally L-shaped assembly, so that said second generally L-shaped assembly is replaceably suspended from, and vertically adjustable below, the doorknob on the second opposing side of the open door so as to allow for exercisers of different heights;

g) second height maintaining means for maintaining said second generally L-shaped assembly a preselected vertical distance below the doorknob on the second opposing side of the open door; and h) a pedal assembly attached to said flat, rectangular-shaped, and narrow portion of said generally L-shaped plate of said second generally L-shaped assembly and replaceably receiving the feet of the exerciser, so that the legs of the exerciser are exercised when said pedal assembly is rotated by action of the legs of the exerciser.

2. The device as define in claim 1, wherein said flat, rectangular-shaped, and wide portion of said generally L-shaped plate of said first generally L-shaped assembly has a flat outer surface, a horizontal and straight upper edge, a flat inner surface, a horizontal and straight lower edge, and a vertical and straight front edge from which said flat, rectangular-shaped, and narrow portion of said generally L-shaped plate of said first generally L-shaped assembly extends perpendicularly inwardly along; said flat, rectangular-shaped, and wide portion of said generally L-shaped plate of said second generally L-shaped assembly has a flat outer surface, a horizontal and straight upper edge, a flat inner surface, horizontal and straight lower edge, and a vertical and straight front edge from which said flat, rectangular-shaped, and narrow portion of said generally L-shaped plate of said second generally L-shaped assembly extends perpendicularly, inwardly along.

3. The device as defined in claim 1, wherein said generally L-shaped plate of said first generally L-shaped assembly and said generally L-shaped plate of said second generally L-shaped assembly are metallic.

4. The device as defined in claim 2, wherein said flat, rectangular-shaped, and narrow portion of said generally L-shaped plate of said first generally L-shaped assembly has a flat outer surface that is continuous with, and extends perpendicularly inwardly from, said flat outer surface of said flat, rectangular L-shaped, and wide portion of said generally L-shaped plate of said first generally L-shaped assembly; said flat, rectangular-shaped, and narrow portion of said generally L-shaped plate of said second generally L-shaped assembly has a flat outer surface that is continuous with, and extends perpendicularly inwardly from, said flat outer surface of said flat, rectangular-shaped, and wide portion of said generally L-shaped plate of said second generally L-shaped assembly.

5. The device as defined in claim 4, wherein said flat, rectangular-shaped, and narrow portion of said generally L-shaped plate of said first generally L-shaped assembly further has a horizontal and straight upper edge that is continuous with, and extends perpendicularly inwardly from, said horizontal and straight upper edge of said flat, rectangular-shaped, and wide portion of said generally L-shaped plate of said first generally L-shaped assembly; said flat, rectangular-shaped, and narrow portion of said generally L-shaped plate of said second generally L-shaped assembly further has a horizontal and straight upper edge that is continuous with, and extends perpendicularly inwardly from, said horizontal and straight upper edge of said flat, rectangular-shaped, and wide portion of said generally L-shaped plate of said second generally L-shaped assembly.

6. The device as defined in claim 2, wherein said flat, rectangular-shaped, and narrow portion of said generally L-shaped plate of said first generally L-shaped assembly further has a flat inner surface that is continuous with, and extends perpendicularly inwardly from, said flat inner surface of said flat, rectangular-shaped, and wide portion of said generally L-shaped plate of said first generally L-shaped assembly; said flat, rectangular-shaped, and narrow portion of said generally L-shaped plate of said second generally L-shaped assembly further has a flat inner surface that is continuous with, and extends perpendicularly inwardly from, said flat inner surface of said flat, rectangular-shaped, and wide portion of said generally L-shaped plate of said second generally L-shaped assembly.

7. The device as defined in claim 5, wherein said flat, rectangular-shaped, and narrow portion of said generally L-shaped plate of said first generally L-shaped assembly further has a horizontal and straight lower edge that is continuous with, and extends perpendicularly inwardly from, said horizontal and straight lower edge of said flat, rectangular-shaped, and wide portion of said generally L-shaped plate of said first generally L-shaped assembly; said flat, rectangular-shaped, and narrow portion of said generally L-shaped plate of said second generally L-shaped assembly further has a horizontal and straight lower edge that is continuous with, and extends perpendicularly inwardly from, said horizontal and straight lower edge of said flat, rectangular-shaped, and wide portion of said generally L-shaped plate of said second generally L-shaped assembly.

8. The device as defined in claim 7, wherein said width maintaining means includes an upper horizontally-elongated width adjusting throughslot that extends through said flat, rectangular-shaped, and narrow portion of said generally L-shaped plate of said second, generally L-shaped assembly, in proximity of, and parallel to, said horizontal and straight upper edge of said flat, rectangular-shaped, and narrow portion of said generally L-shaped plate of said second generally L-shaped assembly; said width maintaining means further includes an upper externally threaded stud that extends perpendicularly outwardly from said flat, rectangular-shaped, and narrow portion of said generally L-shaped plate of said first generally L-shaped assembly, in proximity of said horizontal and straight upper edge of said flat, rectangular-shaped, and narrow portion of said generally L-shaped plate of said first generally L-shaped assembly; said upper externally threaded stud of said width maintaining means freely enters into, and is horizontally movable in, said upper horizontally-elongated width adjusting throughslot in said flat, rectangular-shaped, and narrow portion of said generally L-shaped plate of said second generally L-shaped assembly; said width maintaining means further includes an upper internally threaded knob that threadably engages said upper externally threaded stud of said width maintaining means, so that said first generally L-shaped assembly and said second generally L-shaped assembly are prevented from separating from each other and maintained against the open door.

9. The device as defined in claim 8, wherein said width maintaining means further includes a lower horizontally-elongated width adjusting throughslot that extends through said flat, rectangular-shaped, and narrow portion of said generally L-shaped plate of said second generally L-shaped assembly, in proximity of, and parallel to, said horizontal and straight lower edge of said flat, rectangular-shaped, and narrow portion of said generally L-shaped plate of said second generally L-shaped assembly; said width maintaining means further includes a lower externally threaded stud that extends perpendicularly outwardly from said flat, rectangular-shaped, and narrow portion of said generally L-shaped plate of said first generally L-shaped assembly, in proximity of said horizontal and straight lower edge of said flat, rectangular-shaped, and narrow portion of said generally L-shaped plate of said first generally L-shaped assembly; said lower externally threaded stud of said width maintaining means freely enters into, and is horizontally movable in, said lower horizontally-elongated width adjusting throughslot in said flat, rectangular-shaped, and narrow portion of said generally L-shaped plate of said second generally L-shaped assembly; said width maintaining means further includes a lower internally threaded knob that threadably engages said lower externally threaded stud of said width maintaining means, so that said first generally L-shaped assembly and said second generally L-shaped assembly are further prevented from separating from each other and further maintained against the open door.

10. The device as defined in claim 2, wherein said first generally L-shaped assembly further includes a rectangular-shaped cushion pad that is deformable and attached to, and covers entirety of, said flat inner surface of said flat, rectangular-shaped, and wide portion of said generally L-shaped plate of said first generally L-shaped assembly, so that said rectangular-shaped cushion pad of said first generally L-shaped assembly can deform to match the contour of the first side of the open door on which said generally L-shaped plate of said first generally L-shaped assembly abuts against and thereby provides a more secure fit for said generally L-shaped plate of said first generally L-shaped assembly while protecting the first side of the open door from possible damage thereto caused by said generally L-shaped plate of said first generally L-shaped assembly; said second generally L-shaped assembly further includes a rectangular-shaped cushion pad that is deformable and attached to, and covers entirety of, said flat inner surface of said flat, rectangular-shaped, and wide portion of said generally L-shaped plate of said second generally L-shaped assembly, so that said rectangular-shaped cushion pad of said second generally L-shaped assembly can deform to match the contour of the second opposing side of the open door on which said generally L-shaped plate of said second generally L-shaped assembly abuts against and thereby provides a more secure fit for said generally L-shaped plate of said second generally L-shaped assembly while protecting the second opposing side of the open door from possible damage thereto caused by said generally L-shaped plate of said second generally L-shaped assembly.

11. The device as defined in claim 10, wherein said rectangular-shaped cushion pad of said first generally L-shaped assembly and said rectangular-shaped cushion pad of said second generally L-shaped assembly are cloth.

12. The device as defined in claim 2, wherein said first height maintaining means includes a rectangular-parallelepiped-shaped housing that is replaceably attached to said outer surface of said flat, rectangular-shaped, and wide portion of said generally L-shaped plate of said first generally L-shaped assembly and has a rectangular-shaped side with a center, a rectangular-shaped top with a center, and a rectangular-shaped bottom with a center; said second height maintaining means includes a rectangular-parallelepiped-shaped housing that is replaceably attached to said outer surface of said flat, rectangular-shaped, and wide portion of said generally L-shaped plate of said second generally L-shaped assembly and has a rectangular-shaped side with a center, a rectangular-shaped top with a center, and a rectangular-shaped bottom with a center.

13. The device as defined in claim 12, wherein said rectangular-parallelepiped-shaped housing of said first height maintaining means has a rectangular-parallelepiped-shaped and vertically-oriented throughslot that opens into, and extends from, said center of said rectangular-shaped top of said rectangular-parallelepiped-shaped housing of said first height maintaining means vertically downwardly to, and opens into, said center of said rectangular-shaped bottom of said rectangular-parallelepiped-shaped housing of said first height maintaining means; said rectangular-parallelepiped-shaped housing of said second height maintaining means has a rectangular-parallelepiped-shaped and vertically-oriented throughslot that opens into, and extends from, said center of said rectangular-shaped top of said rectangular-parallelepiped-shaped housing of said second height maintaining means vertically downwardly to, and opens into, said center of said rectangular-shaped bottom of said rectangular-parallelepiped-shaped housing of said second height maintaining means.

14. The device as defined in claim 13, wherein said rectangular-parallelepiped-shaped housing of said first height maintaining means further has a threaded throughbore that opens into, and extends from said center of said rectangular-shaped side of said rectangular-parallelepiped-shaped housing of said first height maintaining means horizontally inwardly to, and opens into, said rectangular-parallelepiped-shaped and vertically-oriented throughslot in said rectangular-parallelepiped-shaped housing of said first height adjusting means, so that said threaded throughbore in said center of said rectangular-shaped side of said rectangular-parallelepiped-shaped housing of said first height maintaining means is in communication with said rectangular-parallelepiped-shaped and vertically-oriented throughslot in said rectangular-parallelepiped-shaped housing of said first height maintaining means; said rectangular-parallelepiped-shaped housing of said second height maintaining means further has a threaded throughbore that opens into, and extends from said center of said rectangular-shaped side of said rectangular-parallelepiped-shaped housing of said second height maintaining means horizontally inwardly to, and opens into, said rectangular-parallelepiped-shaped and vertically-oriented throughslot in said rectangular-parallelepiped-shaped housing of said second height adjusting means, so that said threaded throughbore in said center of said rectangular-shaped side of said rectangular-parallelepiped-shaped housing of said second height maintaining means is in communication with said rectangular-parallelepiped-shaped and vertically-oriented throughslot in said rectangular-parallelepiped-shaped housing of said second height maintaining means.

15. The device as defined in claim 14, wherein said flat and slender body portion of said first flat, vertically-oriented, forwardly-facing, and inverted J-shaped height adjusting arm moves vertically in said rectangular-parallelepiped-shaped and vertically-oriented throughslot in said rectangular-parallelepiped-shaped housing of said first height maintaining means; said flat and slender body portion of said second flat, vertically-oriented, forwardly-facing, and inverted J-shaped height adjusting arm moves vertically in said rectangular-parallelepiped-shaped and vertically-oriented throughslot in said rectangular-parallelepiped-shaped housing of said second height maintaining means.

16. The device as defined in claim 15, wherein said flat and slender body portion of said first flat, vertically-oriented, forwardly-facing, and inverted J-shaped height adjusting arm has an outer surface with a plurality of vertically spaced-apart detents therealong; said flat and slender body portion of said second flat, vertically-oriented, forwardly-facing, and inverted J-shaped height adjusting arm has an outer surface with a plurality of vertically spaced-apart detents therealong.

17. The device as defined in claim 16, wherein said first height maintaining means further includes an externally threaded knob that threadably engages said threaded throughbore in said center of said rectangular-shaped side of said rectangular-parallelepiped-shaped housing of said first height maintaining means, and abuts snugly in a selected detent of said plurality of spaced-apart and vertically oriented detents in said flat outer surface of said flat and slender body portion of said first flat, vertically-oriented, forwardly-facing, and inverted J-shaped height adjusting arm, so that said first generally L-shaped assembly can be maintained a comfortable distance below the doorknob on the first side of the open door which is dependent upon the height of the exerciser; said second height maintaining means further includes an externally threaded knob that threadably engages said threaded throughbore in said center of said rectangular-shaped side of said rectangular-parallelepiped-shaped housing of said second height maintaining means, and abuts snugly in a selected detent of said plurality of spaced-apart and vertically oriented detents in said flat outer surface of said flat and slender body portion of said second flat, vertically-oriented, forwardly-facing, and inverted J-shaped height adjusting arm, so that said second generally L-shaped assembly can be maintained a comfortable distance below the doorknob on the second opposing side of the open door which is dependent upon the height of the exerciser.

18. The device as defined in claim 4, wherein said pedal assembly includes a circular-cylindrically-shaped and horizontally-oriented housing that is welded horizontally, at a circular-cylindrically-shaped longitudinal side thereof, to said flat outer surface of said flat, rectangular-shaped, and narrow portion of said generally L-shaped plate of said second generally L-shaped assembly, between said upper horizontally-elongated width adjusting throughslot in said flat, rectangular-shaped, and narrow portion of said generally L-shaped plate of said second generally L-shaped assembly and said lower horizontally-elongated width adjusting: throughslot in said flat, rectangular-shaped, and narrow portion of said generally L-shaped plate of said second generally L-shaped assembly.

19. The device as defined in claim 18, wherein said circular-cylindrically-shaped and horizontally-oriented housing of said pedal assembly further has a pair of ends, a horizontal throughbore that extends longitudinally therethrough and opens into said pair of ends of said circular-cylindrically-shaped and horizontally-oriented housing of said pedal assembly, and a threaded and radially-oriented throughbore that extends radially inwardly from, and opens into, an accessible portion of said circular-cylindrically-shaped longitudinal side of said circular-cylindrically-shaped and horizontally-oriented housing of said pedal assembly to, and opens into, said horizontal throughbore in said circular-cylindrically-shaped and horizontally-oriented housing of said pedal assembly, so that said threaded and radially-oriented throughbore in said circular-cylindrically-shaped and horizontally-oriented housing of said pedal assembly is in communication with said horizontal throughbore in said circular-cylindrically-shaped and horizontally-oriented housing of said pedal assembly.

20. The device as defined in claim 19, wherein said pedal assembly further includes a substantially Z-shaped crank with square bends that has an elongated, slender, and cylindrically-shaped intermediate portion that is rotatively mounted, at a center thereof, in said horizontal throughbore in said circular-cylindrically-shaped and horizontally-oriented housing of said pedal assembly, with bearings therebetween; said pedal assembly substantially Z-shaped crank with square bends of said pedal assembly further has a pair of parallel, elongated, slender, and cylindrically-shaped end portions; each end portion of said pair of parallel, elongated, slender, and cylindrically-shaped end portions of said substantially Z-shaped crank with square bends of said pedal assembly extends perpendicularly outwardly from an end of said elongated, slender, and cylindrically-shaped intermediate portion of said substantially Z-shaped crank with square bends of said pedal assembly, in opposite directions from each other, and has a free end.

21. The device as defined in claim 20, wherein said free end of each end portion of said pair of parallel, elongated, slender, and cylindrically-shaped end portions of said substantially Z-shaped crank with square bends of said pedal assembly has rotatively disposed thereon, a foot pedal sub-assembly that is rotatable on an axis parallel to said elongated, slender, and cylindrically-shaped intermediate portion of said substantially Z-shaped crank with square bends of said pedal assembly.

22. The device as defined in claim 21, wherein each foot pedal sub-assembly of said pedal assembly includes a pedal that is rotatively attached to said free end of each end portion of said pair of parallel, elongated, slender, and cylindrically-shaped end portions of said substantially Z-shaped crank with square bends of said pedal assembly, so that the feet of the legs of the exerciser can rest thereon during exercising, and an elastic strap that is attached at ends thereof to said pedal of each said foot pedal sub-assembly of said pedal assembly, so that the feet of the legs of the exerciser can be releasably maintained in each said foot pedal sub-assembly of said pedal assembly.

23. The device as defined in claim 20, wherein said pedal assembly further includes an externally threaded tension adjusting knob that threadably engages said threaded and radially-oriented throughbore in said circular-cylindrically-shaped and horizontally-oriented housing of said pedal assembly, and abuts with selective tension against, said center of said elongated, slender, and cylindrically-shaped intermediate portion of said substantially Z-shaped crank with square bends of said pedal assembly, so that amount of resistance applied to said pedal assembly can be varied.

24. The device as defined in claim 18; further comprising an electronic timing device disposed on said flat outer surface of said flat, rectangular-shaped, and narrow portion of said generally L-shaped plate of said second generally L-shaped assembly, between said upper horizontally-elongated width adjusting throughslot in said flat, rectangular-shaped, and narrow portion of said generally L-shaped plate of said second generally L-shaped assembly and said circular-cylindrically-shaped and horizontally-oriented housing of said pedal assembly, so that said electronic timing device is easily visible during exercising so as to allow length of a workout to be easily monitored.

25. The device as defined in claim 24, wherein said electronic timing device has an alarm that can be preset to sound when a preselected workout time has been reached.

26. The device as defined in claim 1; further comprising a floor pad positionable on a floor, so that the exerciser can rest comfortably thereon during exercising; said floor pad having a wedge shaped door stop end wedgable between the free lower horizontal edge of the open door and the floor, so that the open door is maintained in an open position, and a head rest end, so that the head of the exerciser can comfortably rest thereon during exercising.

27. A method of utilizing a leg exercise device that is replaceably attachable to an open door having a free lower horizontal edge, a thickness, a first side with a doorknob extending therefrom, and a second opposing side with a doorknob extending therefrom and being opposite to the first side of the open door, comprising the steps of:

a) opening the door;

b) positioning a floor pad of said leg exercise device on a floor, inline with the open door;

c) wedging a wedge shaped door stop end of said floor pad between the free lower horizontal edge of the open door and the floor, so that the open door in maintained in an open position;

d) loosening an upper internally threaded width maintaining knob of said leg exercise device, so that said leg exercise device can be adjusted to the thickness of the open door;

e) loosening a lower internally threaded width maintaining knob of said leg exercise device, so that said leg exercise device can be further adjusted to the thickness of the open door;

f) moving a first generally L-shaped assembly of said leg exercise device and a second generally L-shaped assembly of said leg exercise device relative to each other, so that said leg exercise device can be further adjusted to the thickness of the open door;

g) straddling the free vertical edge of the open door with said first generally L-shaped assembly and said second generally L-shaped assembly, so that said leg exercise device is positioned on the open door;

h) hooking a forward-facing hook portion of a first flat, vertically-oriented, forwardly-facing, and inverted J-shaped height adjusting arm of said leg exercise device onto the doorknob on the first side of the open door, so that said leg exercise device is suspended from the doorknob on the first side of the open door;

i) hooking a forward-facing hook portion of a second flat, vertically-oriented, forwardly-facing, and inverted J-shaped height adjusting arm of said leg exercise device onto the doorknob on the second opposing side of the open door, so that said leg exercise device is further suspended from the doorknob on the second opposing side of the open door;

j) loosening an externally threaded knob of said first generally L-shaped assembly, so that said leg exercise device can be adjusted to a comfortable vertical position on the first side of the open door which is dependent upon height of an exerciser;

k) loosening an externally threaded knob of said second generally L-shaped assembly, so that said leg exercise device can be further adjusted to a comfortable vertical position on the second opposing side of the open door which is dependent upon the height of the exerciser;

l) sliding said first generally L-shaped assembly vertically along a flat and slender body portion of said first flat, vertically-oriented, forwardly-facing, and inverted J-shaped height adjusting arm to the comfortable vertical position on the first side of the open door, so that said leg exercise device is adjusted to the comfortable vertical position on the first side of the open door;

m) sliding said second generally L-shaped assembly vertically along a flat and slender body portion of said second flat, vertically-oriented, forwardly-facing, and inverted J-shaped height adjusting arm to the comfortable vertical position on the second opposing side of the open door, so that said leg exercise device is further adjusted to the comfortable vertical position on the second opposing side of the open door;

n) tightening said externally threaded knob of said first generally L-shaped assembly until it engages snugly in an appropriate detent of a plurality of vertically spaced-apart detents in a flat outer surface of said flat and slender body portion of said first flat, vertically-oriented, forwardly-facing, and inverted J-shaped height adjusting arm, so that said leg exercise device is maintained at the comfortable vertical position on the first side of the open door;

o) tightening said externally threaded knob of said second generally L-shaped assembly until it engages snugly in an appropriate detent of a plurality of vertically spaced-apart detentsin a flat outer surface of said flat and slender body portion of said second flat, vertically-oriented, forwardly-facing, and inverted J-shaped height adjusting arm, so that said leg exercise device is further maintained at the comfortable vertical position on the second opposing side of the open door;

p) moving said first generally L-shaped assembly and said second generally L-shaped assembly relative to each other until said first generally L-shaped assembly abuts against the first side of the open door and the free vertical edge of the open door, and said second generally L-shaped assembly abuts against said second opposing side of the open door and overlaps a part of said second generally L-shaped assembly, so that said leg exercise device is adjusted to the thickness of the open door;

q) tightening said upper internally threaded width maintaining knob, so that said leg exercise device is maintained at the thickness of the open door;

r) tightening said lower internally threaded width maintaining knob, so that said leg exercise device is further maintained at the thickness of the open door;

s) lying the exerciser down on said floor pad with a head of the exerciser resting comfortably on a head rest end of said floor pad, so that the exerciser can comfortably exercise;

t) engaging each foot of feet of legs of the exerciser in each foot pedal sub-assembly of a pedal assembly of said leg exercise device, so that the feet of the legs of the exerciser straddle the open door; and u) rotating a substantially Z-shaped crank with square bends of said pedal assembly, so that the legs of the exerciser are being exercised.

28. The method as defined in claim 27; further comprising the step of varying the distance that a torso of the exerciser is from the open door, so that different amounts of resistance can be applied.

29. The method as defined in claim 27; further comprising the steps of threading am externally threaded tension adjusting knob relative to a threaded and radially-oriented throughbore in a circular-cylindrically-shaped and horizontally-oriented housing of said pedal assembly; and abutting, with selective tension, said externally threaded tension adjusting knob against a center of an elongated, slender, and cylindrically-shaped intermediate portion of said substantially Z-shaped crank with square bends of said pedal assembly, so that amount of resistance applied to said pedal assembly can be varied.

30. A method of exercising at least one leg of an exerciser, comprising the step of exercising with a leg exercise device which comprises:

a) a first generally L-shaped assembly having a generally L-shaped plate with a flat, rectangular-shaped, and wide portion abuttable against a first side of an open door below a doorknob on the first side of the open door, and a flat, rectangular-shaped, and narrow portion being narrower than, and extending perpendicularly inwardly from, the flat, rectangular-shaped, and wide portion of the generally L-shaped plate of the first generally L-shaped assembly and being abuttable against a free vertical edge of the open door;

b) a second generally L-shaped assembly having a generally L-shaped plate with a flat, rectangular-shaped, and wide portion abuttable against a second opposing side of the open door below a doorknob on the second opposing side of the open door, and a flat, rectangular-shaped, and narrow portion being narrower than, and extending perpendicularly inwardly from the flat, rectangular-shaped, and wide portion of the generally L-shaped plate of the second generally L-shaped assembly and over, lapping said flat, rectangular shaped, and narrow portion of said generally L-shaped plate of said first generally L-shaped assembly and being horizontally adjustable therewith, so that said leg exercise device can be used on open doors of different thicknesses;

c) width maintaining means for maintaining said overlap of said flat, rectangular-shaped, and narrow portion of said generally L-shaped plate of said second generally L-shaped assembly on said flat, rectangular-shaped, and narrow portion of said generally L-shaped plate of said first generally L-shaped assembly with said flat, rectangular-shaped, and wide portion of said generally L-shaped plate of said second generally L-shaped assembly being displaced a distance from said flat, rectangular-shaped, and wide portion of said generally L-shaped plate of said first generally L-shaped assembly equal to thickness of the open door, so that the open door is replaceably engaged therebetween;

d) a first flat, vertically-oriented, forwardly-facing, and inverted J-shaped height adjusting arm having a forward facing hook portion being replaceably hookable on the doorknob on the first side of the open door, and a flat and slender body portion being vertically movably adjustably mounted to said flat, rectangular-shaped, and wide portion of said generally L-shaped plate of said first generally L-shaped assembly, so that said first generally L-shaped assembly is replaceably suspended from, and vertically adjustable below, the doorknob on the first side of the open door so as to allow for exercisers of different heights;

e) first height maintaining means for maintaining said first generally L-shaped assembly a preselected vertical distance below the doorknob on the first side of the open door;

f) a second flat, vertically-oriented, forwardly-facing, and inverted J-shaped height adjusting arm having a forward facing hook portion being replaceably hookable on the doorknob on the second opposing side of the open door, and a flat and slender body portion being vertically movably adjustably mounted to said flat, rectangular-shaped, and wide portion of the generally L-shaped plate of the second generally L-shaped assembly, so that said second generally L-shaped assembly is replaceably suspended from, and vertically adjustable below, the doorknob on the second opposing side of the open door so as to allow for exercisers of different heights;

g) second height maintaining means for maintaining said second generally L-shaped assembly a preselected vertical distance below the doorknob on the second opposing side of the open door; and h) a pedal assembly attached to said flat, rectangular-shaped, and narrow portion of said generally L-shaped plate of said second generally L-shaped assembly and replaceably receiving feet of an exerciser, so that legs of the exerciser are exercised when said pedal assembly is rotated by action of the legs of the exerciser.

* * * * *